US006866486B2

(12) United States Patent
Dexter et al.

(10) Patent No.: US 6,866,486 B2
(45) Date of Patent: Mar. 15, 2005

(54) PRESSURE WASHER HAVING OILLESS HIGH PRESSURE PUMP

(75) Inventors: Shane Dexter, Humboldt, TN (US); Mark W. Wood, Jackson, TN (US); Allen Palmer, Lexington, TN (US); William B. Daniel, Pinson, TN (US)

(73) Assignee: DeVilbiss Air Power Company, Jackson, TN (US)

( * ) Notice: Subject to any disclaimer, the term of this patent is extended or adjusted under 35 U.S.C. 154(b) by 0 days.

(21) Appl. No.: 10/797,175

(22) Filed: Mar. 10, 2004

(65) Prior Publication Data

US 2004/0175278 A1 Sep. 9, 2004

Related U.S. Application Data

(63) Continuation of application No. 10/087,899, filed on Mar. 1, 2002, which is a continuation-in-part of application No. 09/639,435, filed on Aug. 14, 2000, now Pat. No. 6,431,844, and a continuation-in-part of application No. 09/639,573, filed on Aug. 14, 2000, now Pat. No. 6,467,394, and a continuation-in-part of application No. 09/639,572, filed on Aug. 14, 2000, now Pat. No. 6,397,729.

(60) Provisional application No. 60/357,766, filed on Feb. 19, 2002.

(51) Int. Cl.[7] ..... F04B 49/00

(52) U.S. Cl. ..... 417/299; 92/150

(58) Field of Search ..... 417/36, 300, 299, 417/307; 92/84, 137, 150

(56) References Cited

U.S. PATENT DOCUMENTS

| | | | | | |
|---|---|---|---|---|---|
| 4,926,904 | A | * | 5/1990 | Polk et al. | 137/565.15 |
| 5,871,152 | A | * | 2/1999 | Saney | 239/8 |
| 6,431,844 | B1 | * | 8/2002 | Dexter et al. | 417/299 |
| 6,467,394 | B1 | * | 10/2002 | Wood et al. | 92/150 |

* cited by examiner

*Primary Examiner*—Thor Campbell
(74) *Attorney, Agent, or Firm*—Suiter West PC LLO

(57) ABSTRACT

An oilless high pressure pump suitable for use in devices such as pressure washers and the like is described. The pump includes an eccentric assembly suitable for converting rotary motion of a rotating shaft to rectilinear motion. One or more straps couple the eccentric assembly to a piston assembly. The straps communicate the rectilinear motion of the eccentric assembly to the piston assembly, reciprocating the piston assembly to pump the liquid.

24 Claims, 20 Drawing Sheets

PRESSURE WASHER HAVING OILLESS HIGH PRESSURE PUMP

CROSS REFERENCE TO RELATED APPLICATIONS

The present application is a continuation application of U.S. patent application Ser. No. 10/087,899, filed Mar. 1, 2002, which is a continuation-in-part application of U.S. patent application Ser. Nos. 09/639,435; 09/639,572 and 09/639,573 each filed Aug. 14, 2000, now U.S. Pat. Nos. 6,431,844; 6,397,729; and 6,467,394, respectively. Said U.S. patent application Ser. Nos. 10/087,899; 09/639,435; 09/639,572 and 09/639,573 and U.S. Pat. Nos. 6,431,844; 6,397,729 and 6,467,394 are herein incorporated by reference in their entirety.

U.S. patent application Ser. No. 10/087,899 also claims the benefit under 35 U.S.C. § 119(e) of U.S. Provisional Application Serial No. 60/357,766, filed Feb. 19, 2002. Said U.S. Provisional Application Ser. No. 60/357,766 is herein incorporated by reference in its entirety.

TECHNICAL FIELD OF THE INVENTION

The present invention generally relates to the field of devices such as pressure washers and the like that are capable of delivering a fluid from a supply source and discharging it at a greater pressure, and more particularly to an oilless high pressure pump suitable for use in such devices.

BACKGROUND ART

High pressure washing devices, commonly referred to as pressure washers, deliver a fluid, typically water, under high pressure to a surface to be cleaned, stripped or prepared for other treatment. Pressure washers are produced in a variety of designs and can be used to perform numerous functions in industrial, commercial and home applications. Pressure washers typically include an internal combustion engine or electric motor that drives a pump to which a high-pressure spray wand is coupled via a length of hose. Pressure washers may be stationary or portable. Stationary pressure washers are generally used in industrial or commercial applications such as car washes or the like. Portable pressure washers typically include a power/pump unit that can be carried or wheeled from place to place. A source of water, for example, a garden hose, is connected to the pump inlet and the high-pressure hose and spray wand is connected to the pump outlet.

Typically, pressure washers utilize a piston pump having one or more reciprocating pistons for delivering liquid under pressure to the high-pressure spray wand. Such piston pumps often utilize two or more pistons to provide a generally more continuous spray, higher flow rate, and greater efficiency. Multiple piston pumps typically employ articulated pistons (utilizing a journal bearing and wrist pins) or may utilize a swash plate and linear pistons for pumping the liquid. Because these piston arrangements generate a substantial amount of friction (such as for example, sliding friction between the swash plate and pistons), existing pumps are typically oil flooded to provide adequate lubrication. However, such oil-lubricated pumps have several drawbacks. For example, the lubricating oil must be maintained at an adequate level and typically must be periodically replaced. Neglect of such maintenance can result in damage to the pump. Further, the orientation in which the pump may be mounted to the pressure washer frame is severely limited.

SUMMARY OF THE INVENTION

Accordingly, the present invention is directed to an oilless high pressure pump suitable for use in devices such as pressure washers and the like to pump a liquid. In an exemplary embodiment, the pump includes an eccentric assembly suitable for converting rotary motion of a rotating shaft to rectilinear motion. One or more straps couple the eccentric assembly to the pump's piston assembly. The straps communicate the rectilinear motion of the eccentric assembly to the piston assembly for reciprocating the pump's pistons to pump the liquid.

It is to be understood that both the forgoing general description and the following detailed description are exemplary and explanatory only and are not restrictive of the invention as claimed. The accompanying drawings, which are incorporated in and constitute a part of the specification, illustrate an embodiment of the invention and together with the general description, serve to explain the principles of the invention.

BRIEF DESCRIPTION OF THE DRAWINGS

The numerous advantages of the present invention may be better understood by those skilled in the art by reference to the accompanying figures in which.

DETAILED DESCRIPTION OF THE INVENTION

Reference will now be made in detail to the presently preferred embodiments of the invention, examples of which are illustrated in the accompanying drawings.

Figure 1:
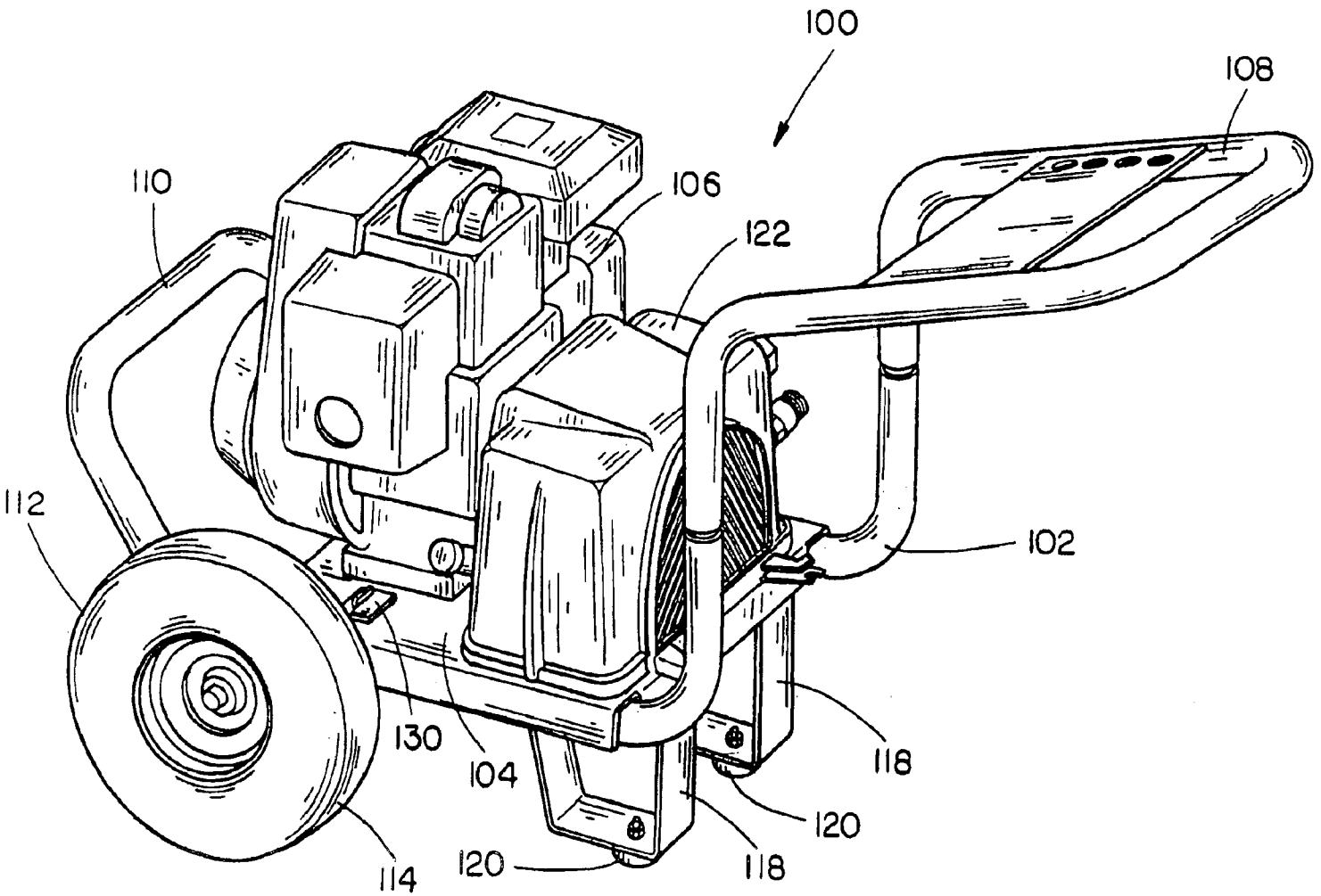
FIG. 1 is an isometric view illustrating an exemplary pressure washer in accordance with an exemplary embodiment of the present invention.

Referring now to FIG. 1, an exemplary pressure washer employing an oilless high pressure pump in accordance with the present invention is described. The pressure washer 100 comprises a frame 102 supporting an engine/pump platform 104 on which a pump such as oilless high-pressure pump 200 (FIGS. 1 through 5A) or 300 (FIGS. 6 through 9B) may be mounted. An internal combustion engine 106, or, alternately, an electric motor, or the like, is mounted to engine/pump platform 104 adjacent to pump 200 or 300 so that the driveshaft of the engine 106 may drive the pump driveshaft assembly. Frame 102 may further include a handle portion 108 and a bumper portion 110. A wheel assembly 112 is mounted to frame 102 below engine/pump platform 104 and adjacent to bumper portion 110. In the exemplary embodiment illustrated, wheel assembly 112 comprises a wheel 114 mounted to each side of frame 102 via an axle 116 attached to the frame 102 below engine/pump platform 104 (see FIG. 17). One or more base supports 118 are mounted to frame 102 opposite wheel assembly 112 below engine/pump platform and adjacent to handle portion 108. The handle portion 108, wheel assembly 112 and base supports 118 cooperate to allow the pressure washer 100 to be transported by lifting upward on the handle portion 108 and pushing the pressure washer much like a conventional wheelbarrow. Preferably, bumper portion 110 prevents damage to engine 106 should the pressure washer 100 be pushed into another object. Non-marring support pads 120 may be attached to the bottom surfaces of base supports 118 to prevent damage to surfaces on which the pressure washer 100 is set. In embodiments of the invention, the height of support pads 120 may be adjusted to allow leveling of the pressure washer 100, for example, on uneven surfaces.

Figure 6:
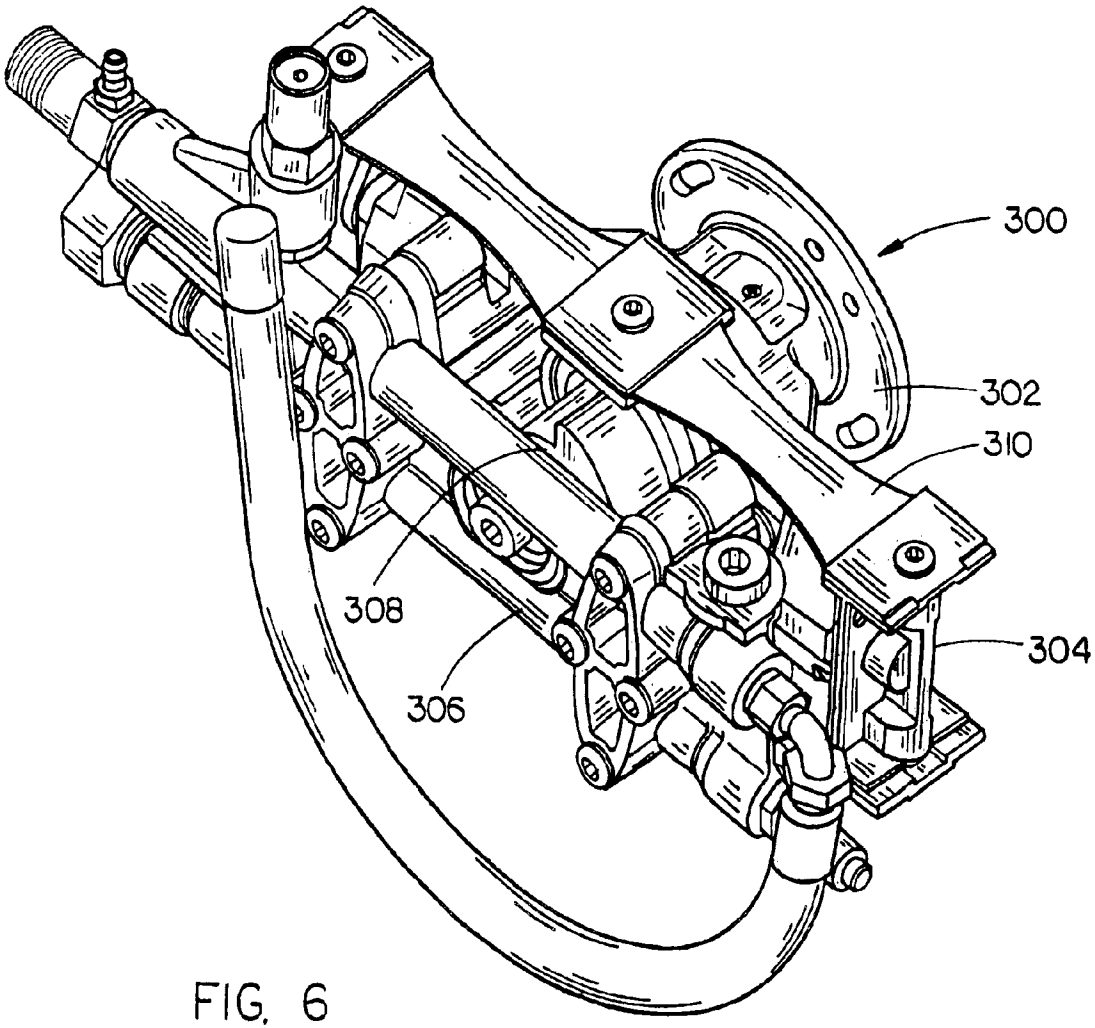
FIG. 6 is an isometric view of an oilless high pressure pump in accordance with a second exemplary embodiment of the present invention wherein the pump includes two cylinder/piston assemblies.

A cover or shroud 122 may be attached to engine/pump platform 104 to surround the pump 200 (FIG. 2) or 300 (FIG. 6). Preferably, the shroud 122 completely surrounds the pump 100 except for openings through which the inlet and outlet of the pump 200 or 300 may extend allowing connection of hoses or the like. In this manner, users or others near the pressure washer 100 are prevented from accessing the pump during operation.

Referring now to FIGS. 2 through 4B, an oilless high-pressure pump in accordance with an exemplary embodiment of the present invention is described. The pump 200 is comprised of a pump housing 202 and a manifold or head assembly 206 coupled to the pump housing 202. A cylinder assembly is formed in the pump housing 202 and head assembly 206 for support a piston assembly 204 suitable for pumping a liquid such as water, or the like. Head assembly 206 further includes ports for porting the liquid to and from the piston assembly 204. An eccentric assembly 208 converts rotary motion of the rotating shaft of an engine or motor (see FIG. 1) to rectilinear motion for reciprocating the piston assembly 204. Flexible straps 210 couple the eccentric assembly 208 to the piston assembly 204 to communicate the rectilinear motion of the eccentric assembly 208 to the piston assembly 204 to pump the liquid. In exemplary embodiments, the eccentric assembly 208 employs sealed, deep grooved permanently lubricated bearing assemblies 212 & 214 allowing the pump 200 to operate with out oil lubrication. However, those of skill in the art will appreciate that other bearing assemblies may be employed without departing from the scope and spirit of the present invention The flexible straps 210 and bearing assemblies 212 & 214 of oilless high pressure pump 200 do not utilize an oil sump for lubrication. Consequently, the pump 200 requires less maintenance than oil flooded high-pressure pumps since the need to periodically change lubricating oil is eliminated. Further, because the pump 200 does not require a lubricating oil sump, it may be mounted in virtually any orientation. The present pump may also provide increased mechanical efficiency compared to pumps employing articulated piston or swash plate/linear piston configurations since flexible straps eliminate losses in mechanical efficiency caused by sliding friction and shearing of lubricating oil in the sump common to such pumps. Typically, articulated piston or swash plate/linear piston pumps operate at less than approximately 75 percent efficiency, while a pump manufactured in accordance with the present invention may operate at efficiencies greater than approximately 85 percent. This increased efficiency allows the pump of the present invention to produce higher pressures using the same power input from the engine. Moreover, in exemplary embodiments, pumps in accordance with the present invention may produce pressure pulsation in the fluid being pumped. When used in certain applications, such as, for example, some pressure washers, such pressure pulsation may be desirable to aid in cleaning a surface, stripping a surface, or the like.

Figure 2:
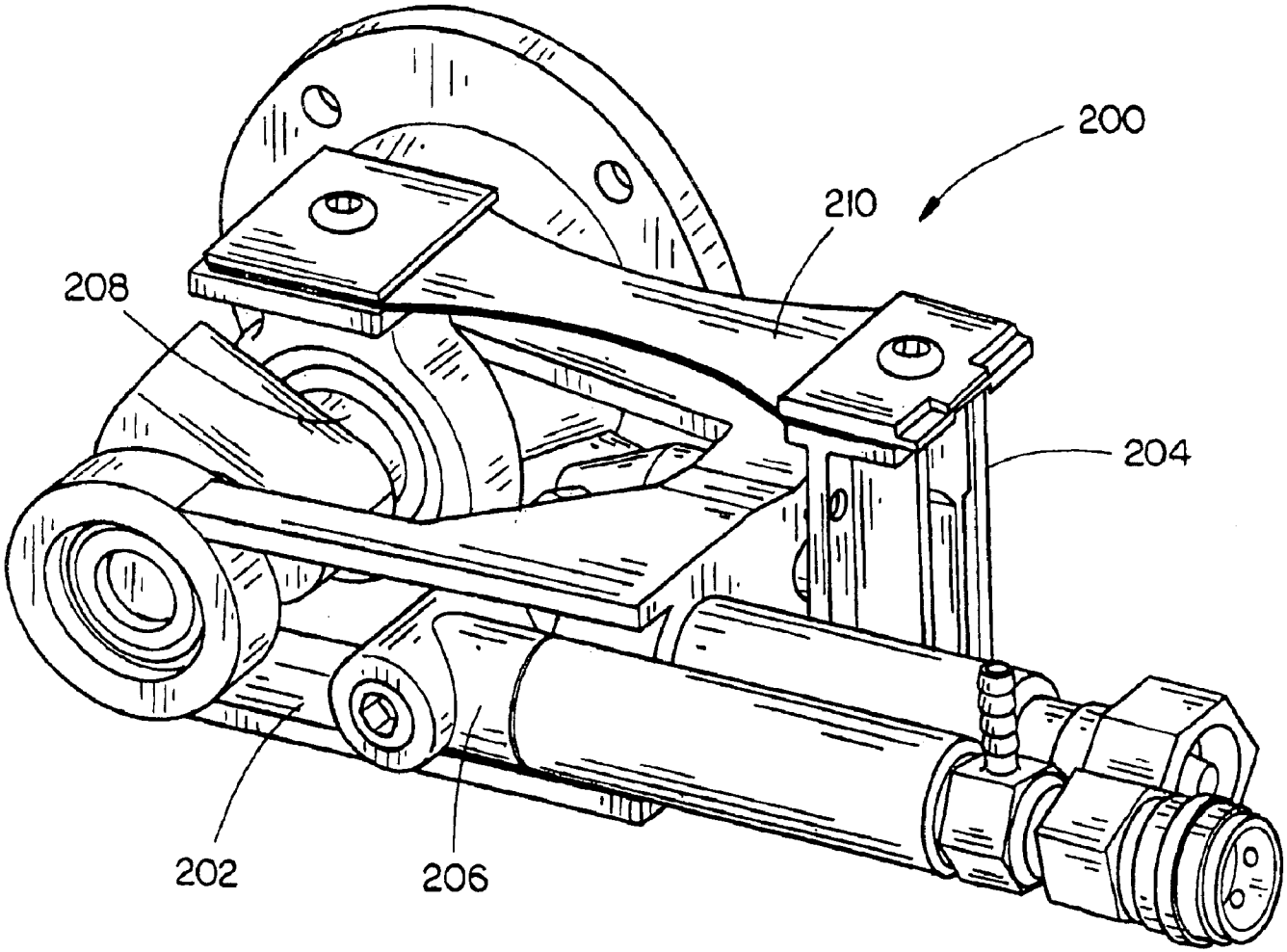
FIG. 2 is an isometric view of an oilless high-pressure pump in accordance with an exemplary embodiment of the present invention.
Figure 3:
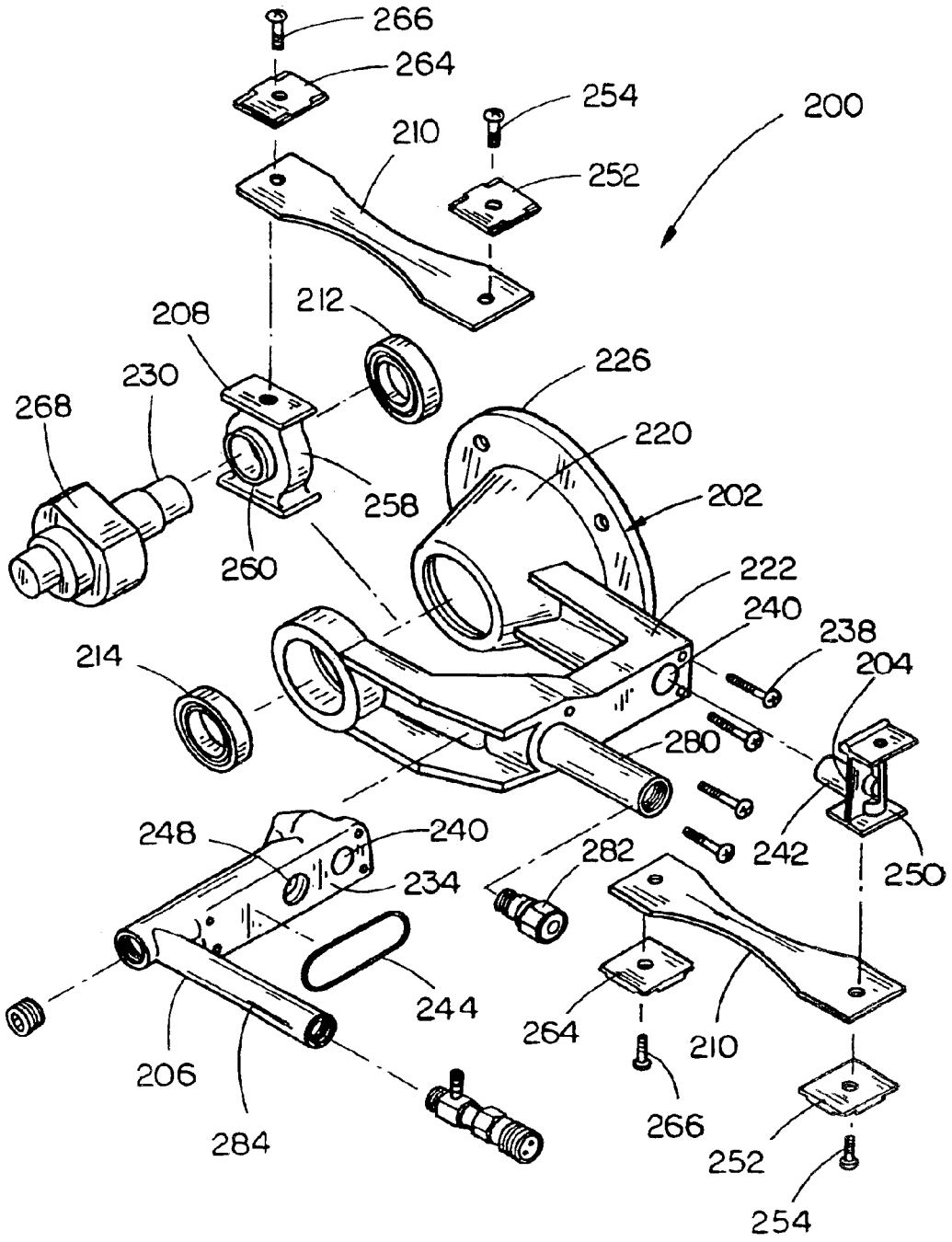
FIG. 3 is an exploded isometric view of the pump shown in FIG. 2 further illustrating the component parts of the pump.

As shown in FIGS. 2 and 3, pump housing 202 includes a pump body 222 having an shaft mounting portion 224 including a flange 226 suitable for coupling the pump 200 to an internal combustion engine or electric motor of a pressure washer, such as pressure washer 100 shown in FIG. 1. Preferably, bearing assembly 212 is mounted in the shaft-mounting portion 224 for supporting shaft 230 that is coupled to the drive shaft of the engine or motor. Head assembly 206 and pump body 222 may further include adjoining bosses 234 coupled via fasteners 238 to form a cylinder 240 in which piston 242 of piston assembly 204 may reciprocate. A seal such as an O-ring gasket, or the like 244 may be disposed between bosses 234 for preventing leakage of the liquid from the cylinder 240 during operation of the pump 200. Bosses 234 further provide a surface for coupling the head assembly 206 to the pump housing 202 and include ports 248 for porting the liquid to and from cylinder 240 and piston assembly 204.

Piston assembly 204 includes a strap coupling member 250 mounted to the outer end of piston 242 for coupling the piston 242 to straps 210. In the exemplary embodiment shown, straps 210 are clamped to the strap-coupling members 250 by end clamp blocks 252 and fasteners 254. This clamping arrangement allows loads to be more evenly distributed through the ends of straps 210.

In an exemplary embodiment, piston 242 is formed of a ceramic material. However, it will be appreciated that piston 242 may alternately be formed of other materials, for example metals such as steel, particularly, nitrated steel, aluminum, steel, brass, or the like without departing from the scope and spirit of the present invention. Cylinder 240 may include a seal providing a surface against which the piston 242 reciprocates and preventing liquid within the cylinder 240 from seeping between the piston 242 and cylinder wall. Preferably, the seal is formed of a suitable seal material such as tetrafluoroethylene polymers or Teflon (Teflon is a registered trademark of E.I. du Pont de Nemours and Company), a butadiene derived synthetic rubber such as Buna N, or the like.

Figure 4:
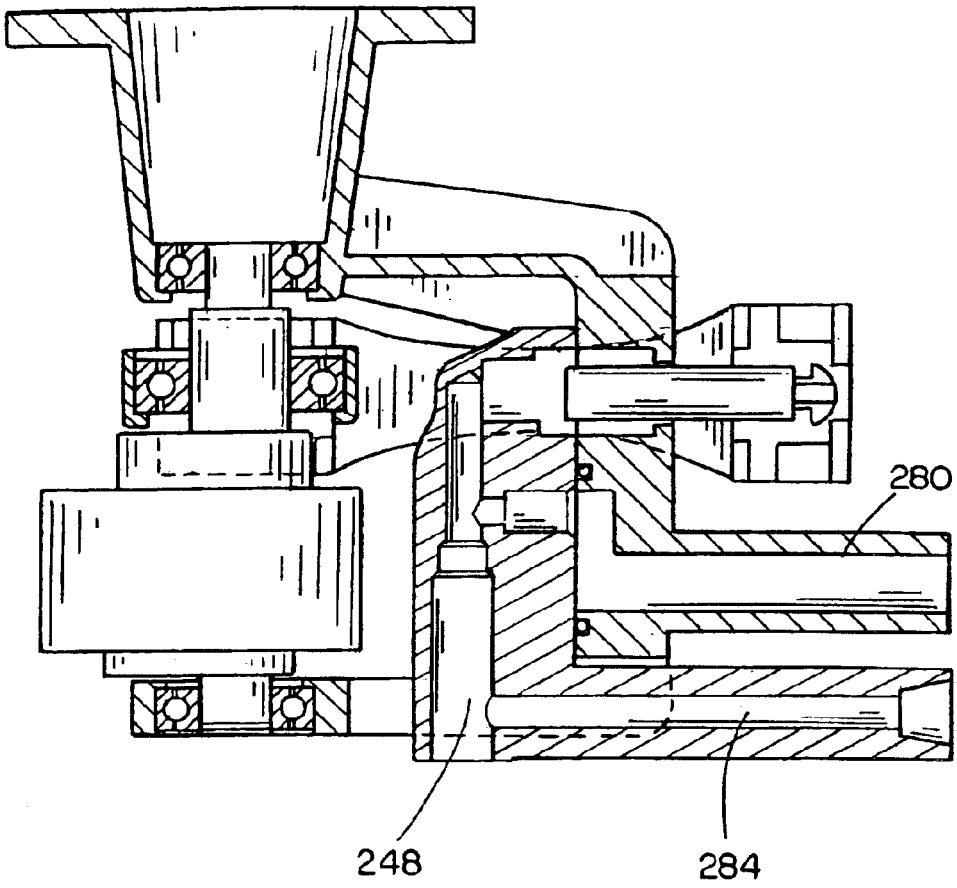
FIG. 4 is a cross-sectional view of the pump shown in FIG. 2, further illustrating the eccentric and sealed bearing assembly of the pump.
Figure 5A:
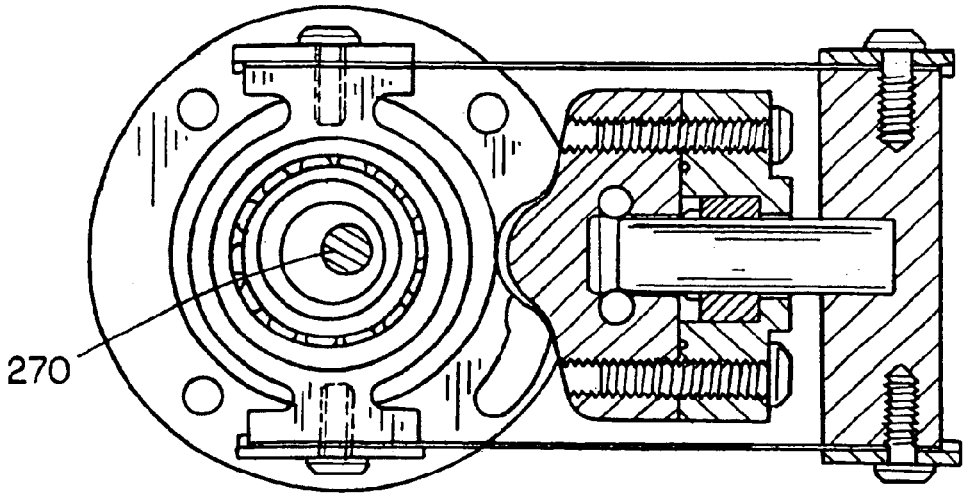
FIGS. 5A and 5B are cross sectional side elevational views illustrating operation of the flexible straps to drive the piston assembly of the pump.
Figure 5B:
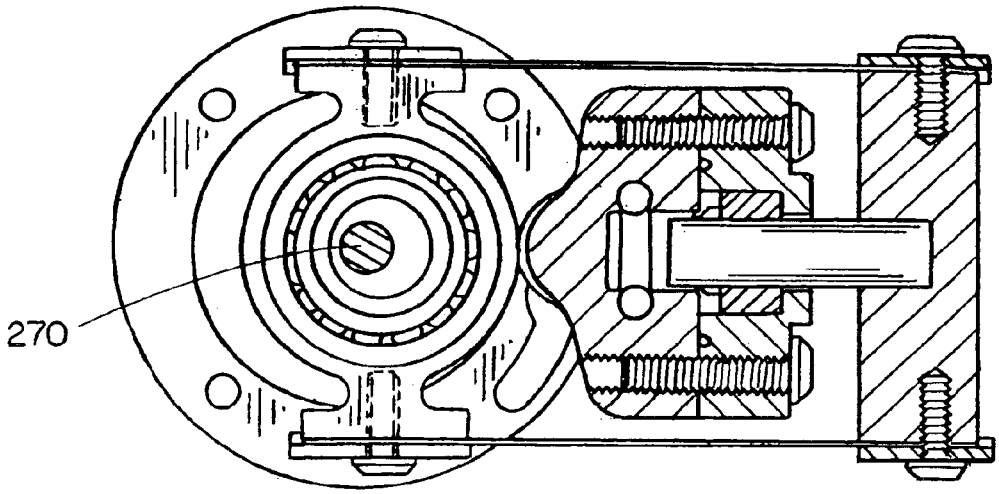

As shown in FIGS. 3 and 4, eccentric assembly 208 includes shaft 230, bearing assemblies 212 & 214, and an eccentric 258. The eccentric 258 is comprised of a ring bearing assembly 260 coupled to bearing assembly 212. Ring bearing assembly 260 is further coupled to straps 210 via clamp blocks 264 and fasteners 266 that clamp the center of straps 210 to the ring bearing assembly 260. This clamping arrangement allows loads within the center of strap 210 to be distributed more evenly. A counterweight 268 balances movement of the eccentric assembly 208 and piston assembly 204 to reduce or substantially eliminate vibration of the pump 200 during operation. Eccentric assembly 208 is secured together by fastener 270 (shown in cross-section in FIGS. 5A and 5B). Preferably, fastener 270 extends through bearing assembly 214, counterweight 268, ring bearing assembly 260, and bearing assembly 212 and is threaded into the center of shaft 230 to clamp these components together. As shown in FIGS. 5A and 5B, a fastener 270 is off-centered in bearing coupling member 262 so that the ring bearing assembly 260 is positioned axially off-center with respect to the center of shaft 230 allowing the eccentric 258 to convert the rotary motion of the shaft 230 to rectilinear motion that is communicated to the piston assembly 204 by straps 210 for reciprocating piston 242. In one embodiment, fastener 270 may engage a collet within bearing assembly 212 for capturing and providing the proper pre-loading of bearing assemblies 212 & 214.

Head assembly 206 is secured to pump body 222 by fasteners 274 extending through bosses 234. Seal 244 prevents leakage of the liquid during operation of the pump 200. Head assembly 206 ports the fluid through the pump 200 where its pressure and/or flow rate of the fluid is increased from a first pressure and/or flow rate to a second pressure and/or flow rate. As shown in FIG. 4, the head assembly 206 includes an inlet or low pressure portion 280 having a connector 282 such as a conventional garden hose connector, or the like for coupling the pump 200 to a source of fluid, for example, household tap water, at a first pressure and/or flow rate. The head assembly 206 also includes an outlet or high pressure portion 284 for supplying the liquid at a second pressure and/or flow rate.

Referring now to FIGS. 5A and 5B, operation of pump 200 is described. As shaft 230 (FIGS. 3 and 4) is turned by an engine or motor, ring bearing assembly 260 of eccentric assembly 208 is moved from side to side converting the rotary motion of the shaft into rectilinear motion. This rectilinear motion is communicated to the piston assembly 204 by straps 210 for reciprocating piston 242. Consequently, the portions of straps 210 extending between the ring bearing assembly 260 and piston assembly 242 are alternately placed in compression during an intake stroke of the piston assembly 242, and in tension during a compression stroke of the piston assembly 242. Pump body 222 and head assembly 206 include porting 248 for providing inlet and outlet ports to cylinder 240 for porting the fluid into and out of the cylinder 240. Preferably, valves shut during the compression stroke of the piston assembly 204 to prevent back flow of the fluid into the inlet portion 280 of head assembly 206.

In exemplary embodiments of the invention, the shape and thickness of flexible straps 210 are optimized to withstand the alternating bending and tension loads placed on them during operation of the pump 200. For example, as shown in FIGS. 2 through 5B, each strap is comprised of a thin strip of steel having a generally hourglass shape that widens adjacent to points of attachment of the strap 210 to the strap coupling members 250 and ring bearing assembly 260. This shape allows the strap 210 to flex and bend as piston assembly 204 is reciprocated, and to distribute loads throughout the strap 210 more evenly. It will be appreciated that the specific shape and thickness of straps 210 will vary depending on the application in which the pump is to be used, the size of the pump, the fluid being pumped, and a the like and may be determined utilizing finite element analysis by one of ordinary skill in the art.

Referring generally to FIGS. 6 through 10B, an oilless high-pressure pump in accordance with a second exemplary embodiment of the present invention is described. The pump 300 is comprised of a pump housing 302 supporting two piston assemblies 304 suitable for pumping a liquid such as water, or the like and a manifold or head assembly 306, coupled to the pump housing 302, for porting the liquid to and from the piston assemblies 304. An eccentric assembly 308 converts rotary motion of the rotating shaft of an engine (see FIG. 6) to rectilinear motion for reciprocating the piston assembly 304. Flexible straps 310 couple the eccentric assembly 308 to the piston assembly 304 to communicate the rectilinear motion of the eccentric assembly 308 to the piston assembly 304 to pump the liquid. In exemplary embodiments, the eccentric assembly 308 employs sealed, deep grooved permanently lubricated bearing assemblies 312 & 314 allowing the pump 300 to operate without oil lubrication.

Like the pump 200 shown in FIG. 2, the flexible straps 310 and sealed bearing assemblies 312 & 314 of oilless high pressure pump 300 do not utilize an oil sump for lubrication. Consequently, the pump 300 requires less maintenance than oil flooded high-pressure pumps since the need to periodically change lubricating oil is eliminated. Further, because the pump 300 does not require a lubricating oil sump, it may be mounted in virtually any orientation. The present pump 300 may also provide increased mechanical efficiency compared to pumps employing articulated piston or swash plate/linear piston configurations since flexible straps 310 eliminate losses in mechanical efficiency caused by sliding friction and shearing of lubricating oil in the sump common to such pumps. Typically, articulated piston or swash plate/linear piston pumps operate at less than approximately 75 percent efficiency, while a pump manufactured in accordance with the present invention may operate at efficiencies greater than approximately 85 percent. This increased efficiency allows the pump 300 to produce higher pressures using the same power input from the engine. For instance, an exemplary pump 300 manufactured in accordance with the present invention and having a rated pressure of 2200 PSI (pounds per square inch) and flow rate of 2.1 GPM (gallons per minute) would provide approximately 200 PSI of additional pressure compared to a corresponding articulated piston or swash plate/linear piston pump using the same power input, or, alternately, would require approximately 0.5 horsepower less power input to produce the same pressure and flow rate.

The axi-linear configuration of pump 300 further allows for the use of less costly materials and manufacturing methods than would be possible in conventional pumps. For instance, because of their complexity, the housings of typical articulated piston or swash plate/linear piston configuration pumps must often be forged. Further, such housing may require the use of materials such as brass due to high stresses encountered during operation of the pumps. However, the axi-linear design of pump 300 allows porting within the pump housing 302 and head assembly 306 to be greatly simplified and substantially reduces the magnitude of stresses incurred during operation. Thus, in exemplary embodiments, the pump body 322 and head assemblies 306 may be formed of die-cast aluminum resulting in substantial cost savings during manufacturing.

Figure 7:
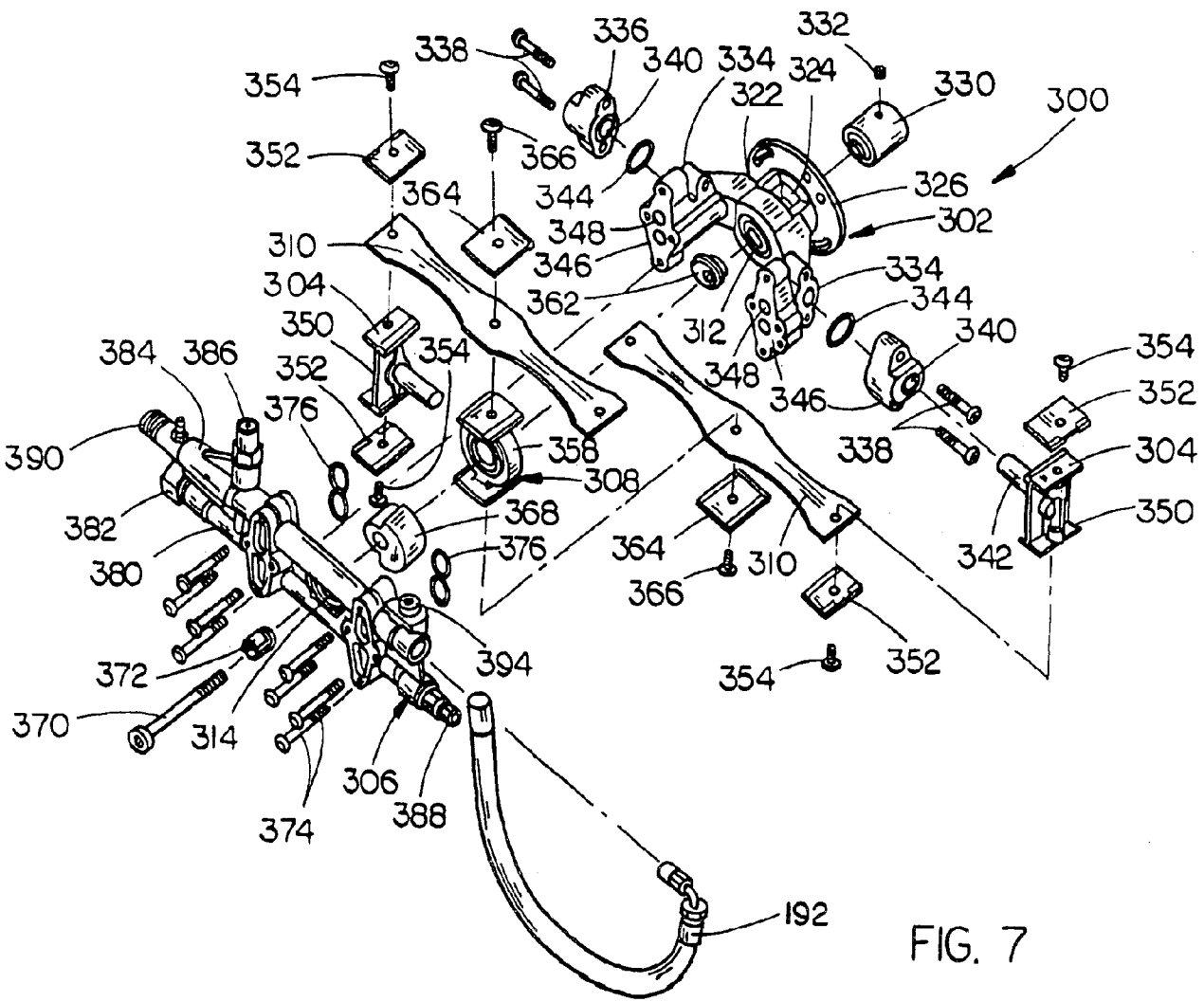
FIG. 7 is an exploded isometric view of the pump shown in FIG. 6 further illustrating the component parts of the pump.
Figure 8:
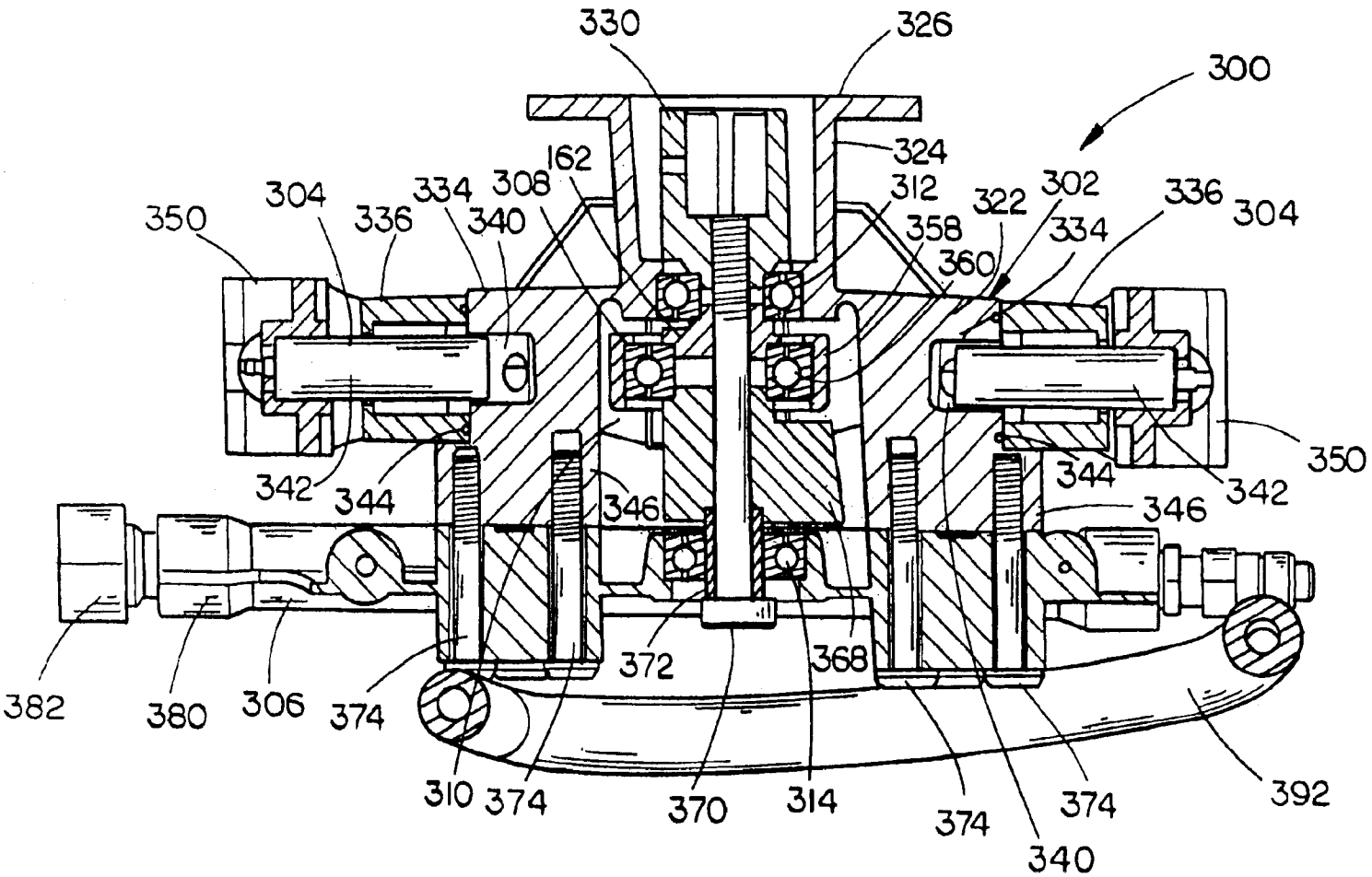
FIG. 8 is a cross-sectional view of the pump shown in FIG. 6, further illustrating the pump's eccentric and sealed bearing assemblies.

Referring now to FIGS. 7 and 8, pump housing 302 includes a pump body 322 having an shaft mounting portion 324 including a flange 326 suitable for coupling the pump 300 to an engine such as the internal combustion engine or electric motor of a pressure washer. Preferably, bearing assembly 312 is mounted in the shaft mounting portion 324 for supporting shaft 330 which is coupled to the drive shaft of an engine (not shown) via key 332. Pump body 322 may further include axi-linearly-opposed cylinder head bosses 334 to which journal bodies 336 are coupled via fasteners 338 to form cylinders 340 in which pistons 342 of piston assemblies 304 may reciprocate. A seal such as an O-ring or the like 344 may be disposed between each cylinder head boss 334 and journal body 336 for preventing leakage of the liquid from the cylinders 340 during operation of the pump 300. Head coupling bosses 346 formed in pump body 322 provide a surface for coupling the head assembly 306 to the pump housing 302 and include ports 348 for porting the liquid to and from the cylinders 340 and piston assemblies 304.

Each piston assembly 304 includes a strap coupling member 350 mounted to the outer end of piston 342 for coupling the piston 342 to straps 310. In the exemplary embodiment shown, straps 310 are clamped to the strap-coupling members 350 by end clamp block 352 and fastener 354. This clamping arrangement allows loads to be more evenly distributed through the ends of straps 310.

In an exemplary embodiment, pistons 342 are formed of a ceramic material. However, it will be appreciated that pistons 342 may alternately be formed of other materials, for example metals such as steel particularly a nitrated steel, aluminum, brass, or the like without departing from the scope and spirit of the present invention. Cylinders 340 formed in journal bodies 336 may include a seal providing a surface against which the piston 342 may reciprocate and for preventing liquid within the cylinder 340 from seeping between the piston 342 and cylinder wall. Preferably, the seal is formed of a suitable seal material such as tetrafluoroethylene polymers or Teflon (Teflon is a registered trademark of E.I. du Pont de Nemours and Company), a butadiene derived synthetic rubber such as Buna N, or the like.

In the exemplary embodiment of the invention shown in FIGS. 7 and 8, eccentric assembly 308 includes shaft 330, bearing assemblies 312 & 314, and an eccentric 358. The eccentric 358 is comprised of a ring bearing assembly 360 and a bearing-coupling member 362 for coupling the ring bearing assembly 360 to bearing assembly 312. Ring bearing assembly 360 is further coupled to straps 310 via clamp blocks 364 and fasteners 366 that clamp the center of straps 310 to the ring bearing assembly 360. This clamping arrangement allows loads within the center of strap 310 to be distributed more evenly. A counterweight 368 may be provided for balancing movement of the eccentric assembly 308 and piston assemblies 304 to reduce or eliminate vibration of the pump 300 during operation. Eccentric assembly 308 is secured together by fastener 370. Preferably, fastener 370 extends through bearing assembly 314, counterweight 368, ring bearing assembly 360, bearing coupling member 362, and bearing assembly 312 and is threaded into the center of shaft 330 to clamp these components together. As shown in FIG. 8, fastener 370 is off-centered in bearing coupling member 362 so that the ring bearing assembly 360 is positioned axially off-center with respect to the center of shaft 330 allowing the eccentric 356 to convert the rotary motion of the shaft 330 into rectilinear motion that is communicated to the piston assemblies 304 by straps 310 for reciprocating pistons 342. Collet 372 is engaged within bearing assembly 312 by fastener 370 for capturing and providing the proper pre-loading of bearing assemblies 312 & 314. The function of fastener 370 and collet 372 is described further in the discussion of FIGS. 13 and 14.

Referring again to FIGS. 7 and 8, head assembly 306 is secured to the head coupling bosses 346 of pump body 322 by fasteners 374. Seals 378 such as a shaped O-ring, gasket, or the like may be disposed between the head assembly 306 and head coupling bosses 346 for preventing leakage of the liquid during operation of the pump 300. Head assembly 306 ports the fluid through the pump 300 where its pressure and/or flow rate of the fluid is increased from a first pressure and/or flow rate to a second pressure and/or flow rate. As shown in FIG. 7, the head assembly 306 includes an inlet or low pressure portion 380 having a connector 382 such as a conventional garden hose connector, or the like for coupling the pump 300 to a source of fluid, for example, household tap water, at a first pressure and/or flow rate. The head assembly 306 also includes an outlet or high pressure portion 384 for supplying the liquid at a second pressure and/or flow rate.

In exemplary embodiments, the head assembly 306 may include a pressure unloader valve 386 for regulating pressure supplied by the pump and a thermal relief valve 388 which may open due to the existence of excessive heat in the liquid being pumped, thereby allowing the liquid to be exit the pump 200. An injector assembly 390 may be provided for injecting a substance, for example, soap, into the fluid supplied by the outlet portion 384. A dampener or pulse hose 392 may be coupled to the outlet portion 384. The pulse hose 392 expands and lengthens to absorb pressure pulsation in the fluid induced by pumping. Alternately, other devices such as a spring piston assembly or the like may be employed instead of the pulse hose 392 to absorb pressure pulsation and substitution of such devices by those of ordinary skill in the art would not depart from the scope and spirit of the present invention.

Head assembly 306 may further include an integral start valve 394 for circulating the fluid within the head assembly 306 between the inlet portion 380 and the outlet portion 384 as the pump is started. The function of start valve 394 is further described in the discussion of FIGS. 11, 12A and 12B.

Figure 9A:
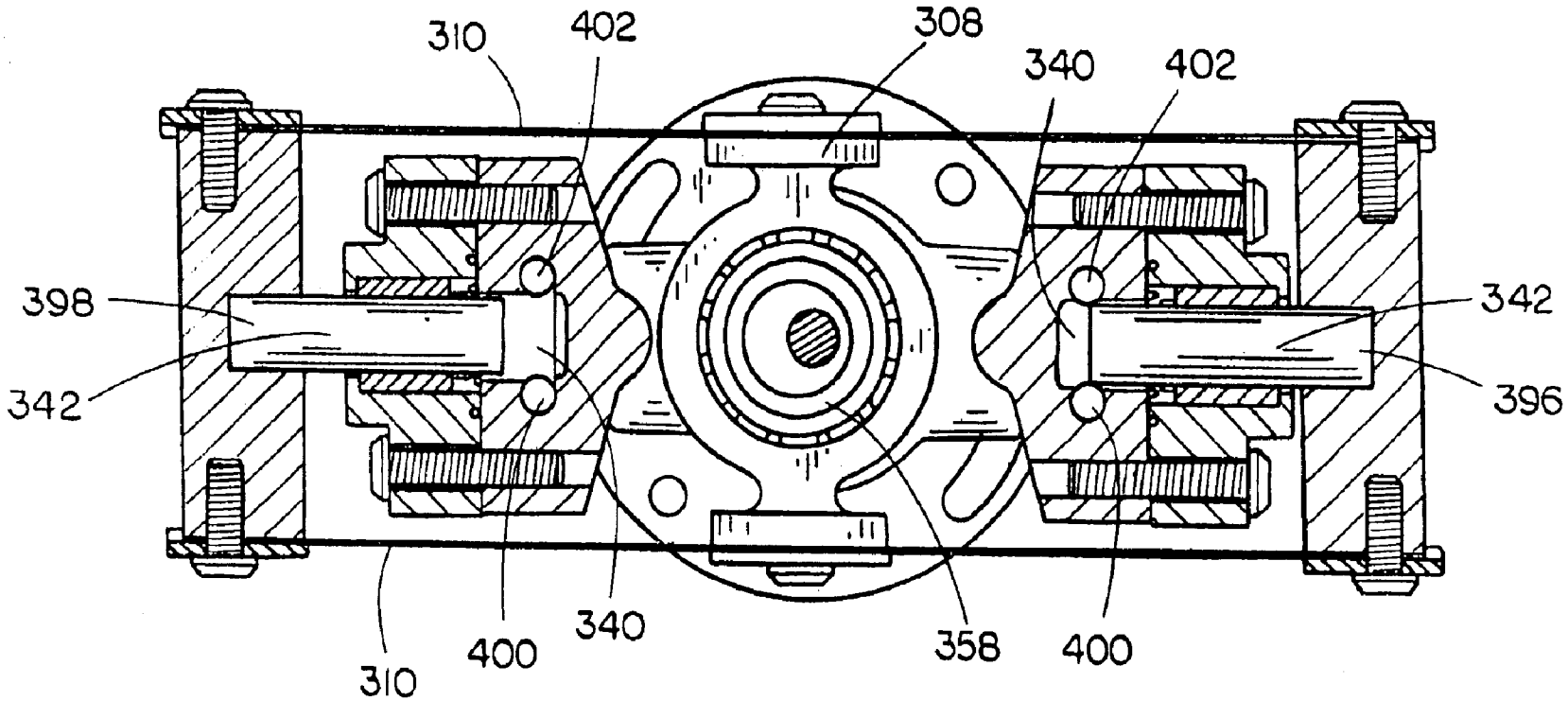
FIGS. 9A and 9B are cross sectional side elevational views illustrating operation of the flexible straps to drive the piston assemblies of the pump.
Figure 9B:
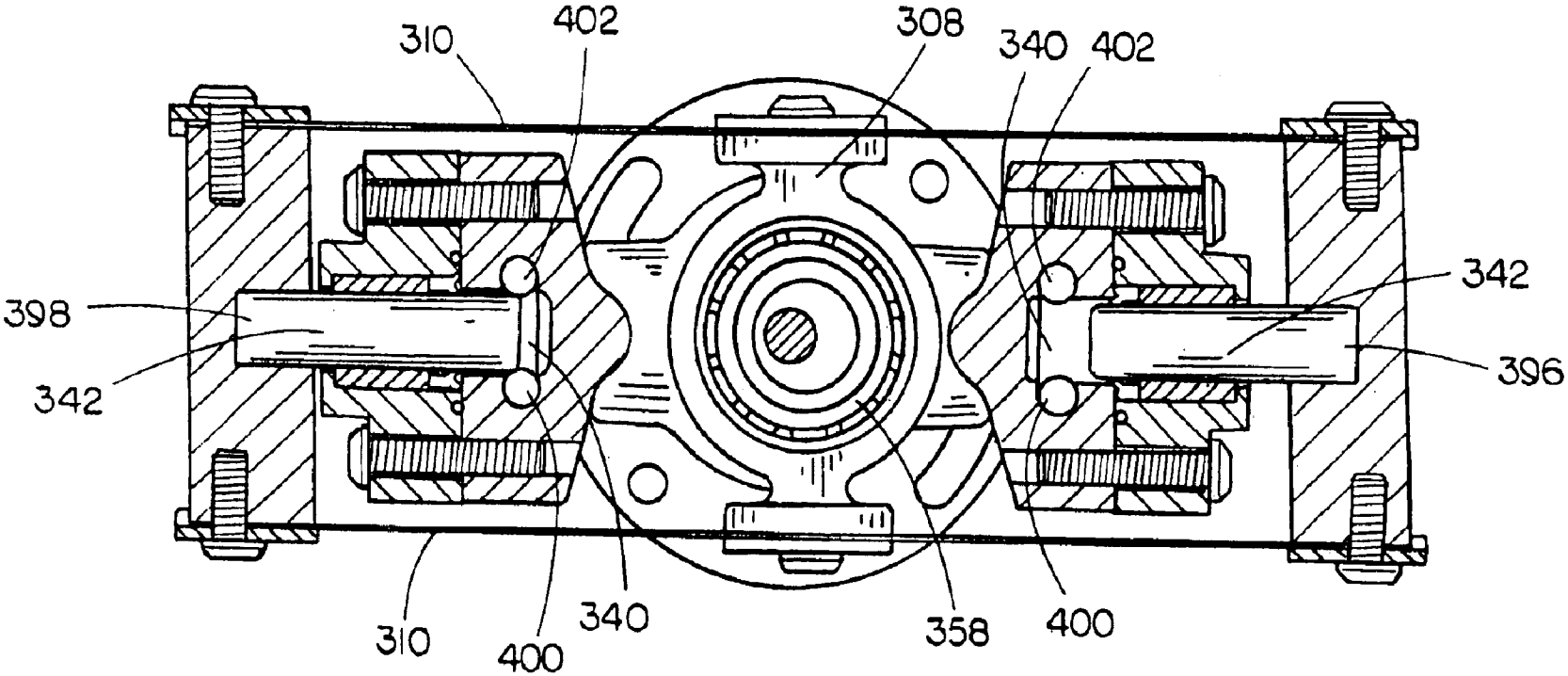

Referring now to FIGS. 9A and 9B, operation of the pump 300 is described. In the exemplary embodiment shown, the pump 300 includes axi-linearly-opposed first and second piston assemblies 396 & 398. As the engine or motor turns shaft 330 (FIGS. 7 and 8), ring bearing assembly 360 of eccentric assembly 308 is moved from side to side converting rotary motion of the shaft into rectilinear motion. This rectilinear motion is communicated to the piston assemblies 304 by straps 310 for reciprocating pistons 342. Thus, as shown in FIG. 9A, as first piston assembly 396 undergoes a compression or pumping stroke for pumping the fluid thereby increasing its pressure and/or flow rate, second piston assembly 398 undergoes an intake stroke allowing fluid to be drawn into cylinder 340. Consequently, the portions of straps 310 extending between the ring bearing assembly 360 and first piston assembly 396 are generally placed in compression, while the portions of straps 310 extending between the ring bearing assembly 360 and second piston assembly 398 are generally placed in tension.

Similarly, as shown in FIG. 4B, as second piston assembly 398 undergoes a compression or pumping stroke, first piston assembly 396 undergoes an intake stroke allowing fluid to be drawn into cylinder 340 of the piston assembly. Thus, the portions of straps 310 extending between the ring bearing assembly 360 and second piston assembly 398 are generally placed in compression, while the portions of straps 310 extending between the ring bearing assembly 360 and first piston assembly 396 are generally placed in tension. Pump body 322 includes porting 348 providing outlet and inlet ports 400 & 402 to cylinders 340 for porting the fluid into and out of the cylinders 340. Preferably, inlet ports 402 include valves that shut during the compression strokes of their respective piston assemblies 396 & 398 to prevent back flow of the fluid into the inlet portion 380 of head assembly 306.

The shape and thickness of flexible straps 310 may be optimized to withstand the alternating bending and tension loads placed on them during operation of the pump 300. For example, in the exemplary embodiment shown in FIGS. 3 through 4B, each strap is comprised of a thin strip of steel having a generally double hourglass shape that widens adjacent to points of attachment of the strap 310 to the strap coupling members 350 and ring bearing assembly 360. This shape allows the strap 310 to flex and bend as piston assemblies 304 are reciprocated, and to distribute loads throughout the strap 310 more evenly.

It will be appreciated that the specific shape and thickness of straps 310 will vary depending on the application in which the pump is to be used, the size of the pump, the fluid being pumped, and a the like and may be determined by those of ordinary skill in the art using known design methods. For example, the shape of straps 310 may be determined utilizing finite element analysis. By way of example, the distribution of maximum Von Mises stress, as determined by finite element analysis, for the straps 310 of an exemplary pump rated at 2200 PSI and having a flow rate of 2.1 GPM is shown in FIGS. 5A and 5B. FIG. 5A illustrates the distribution of maximum Von Mises stress for the straps 310 when subjected to bending loads. As shown, the average maximum stress was determined to be 1.4354 $e^{+04}$ IPS (inch pound second) with a maximum displacement of +1.4200 $e^{-01}$ inches. Similarly, FIG. 5B illustrates the distribution of maximum Von Mises stress for the straps 310 when subjected to tensile loads. As shown, the average maximum stress was determined to be 2.6140 $e^{-01}$ IPS with a maximum displacement of +1.4202 $e^{-01}$ inches.

In the exemplary embodiment of the present invention shown in FIGS. 6 through 10B, head assembly 306 includes an integral start valve 318 for allowing the fluid being pumped to circulate through the head assembly 306 from the inlet portion to the outlet portion bypassing the pump assembly 302 as the engine powering the pump 300 is started. When the pump 300 reaches a predetermined rate of flow of the fluid, the start valve 318 closes to circulate the fluid through said pump assembly 302 so that it may be pumped. In this manner, the pump 300 of the present invention allows the engine from which it receives power to be more easily started because the engine does not have to pump the fluid during as it starts. For example, wherein such an engine is comprised of an internal combustion engine having a pull starter, the user pulling on the pull starter cord will experience less resistance in the pull cord.

Figure 11:
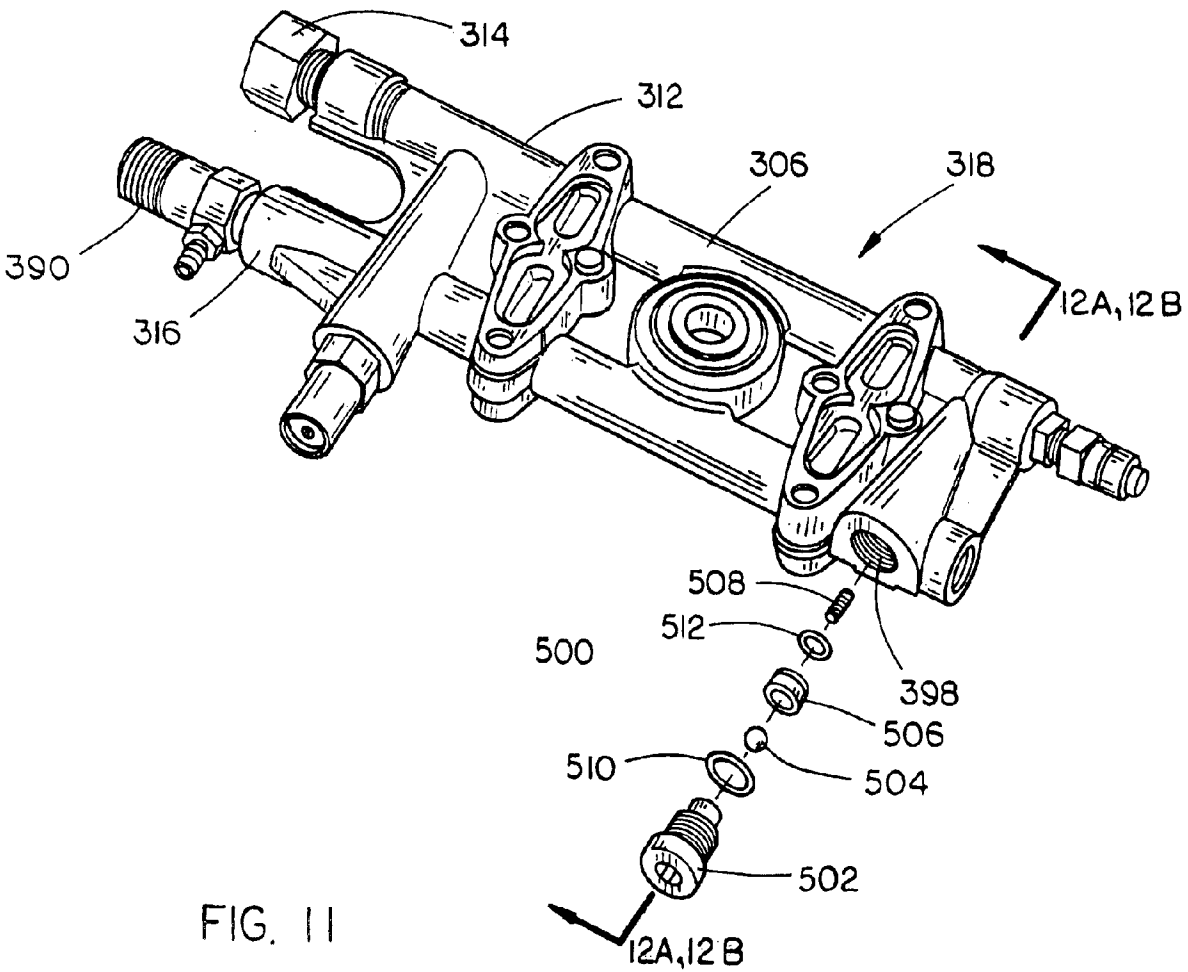
FIG. 11 is a partially exploded isometric view of the head assembly of the pump shown in FIG. 6, further illustrating the integral start valve.
Figure 12A:
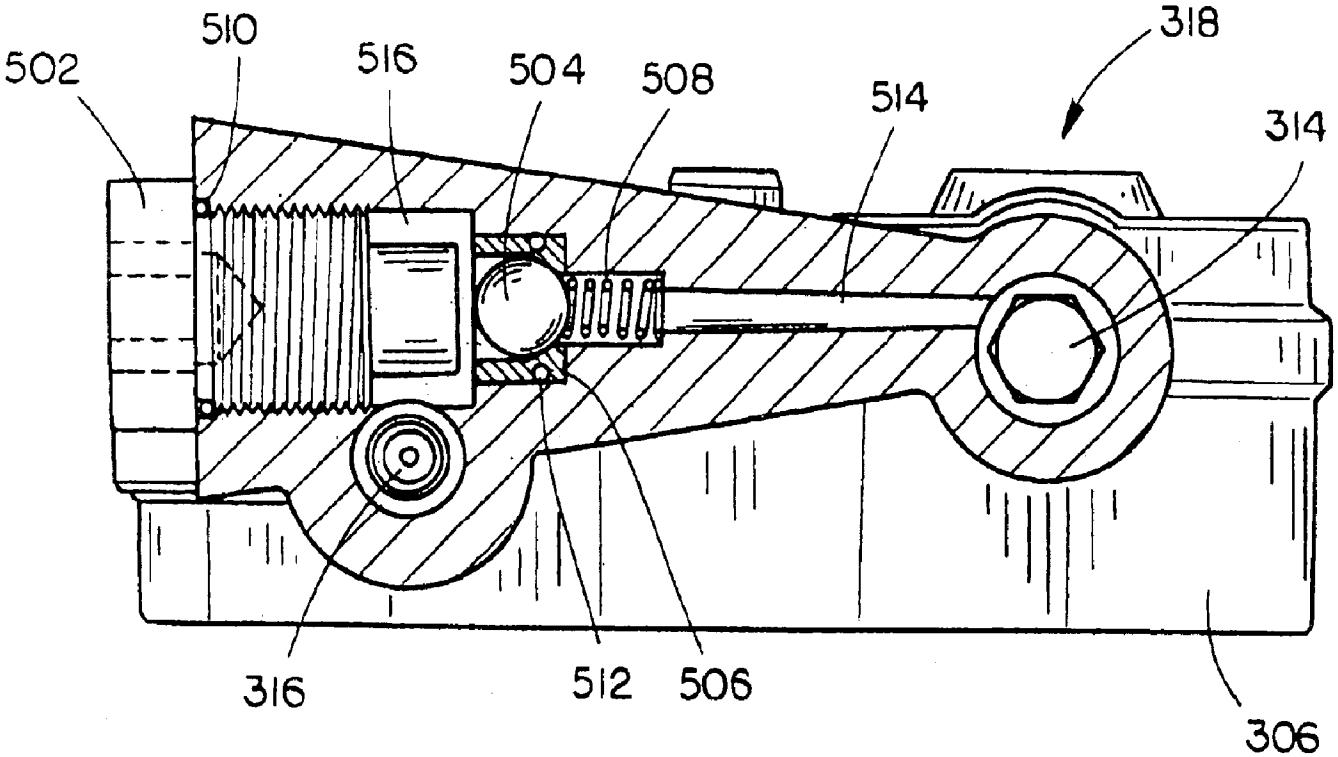
FIGS. 12A and 12B are cross-sectional views of the integral start valve shown in FIG. 11 taken along lines 11A—11A and 11B—11B respectively, further illustrating operation of the start valve.
Figure 12B:
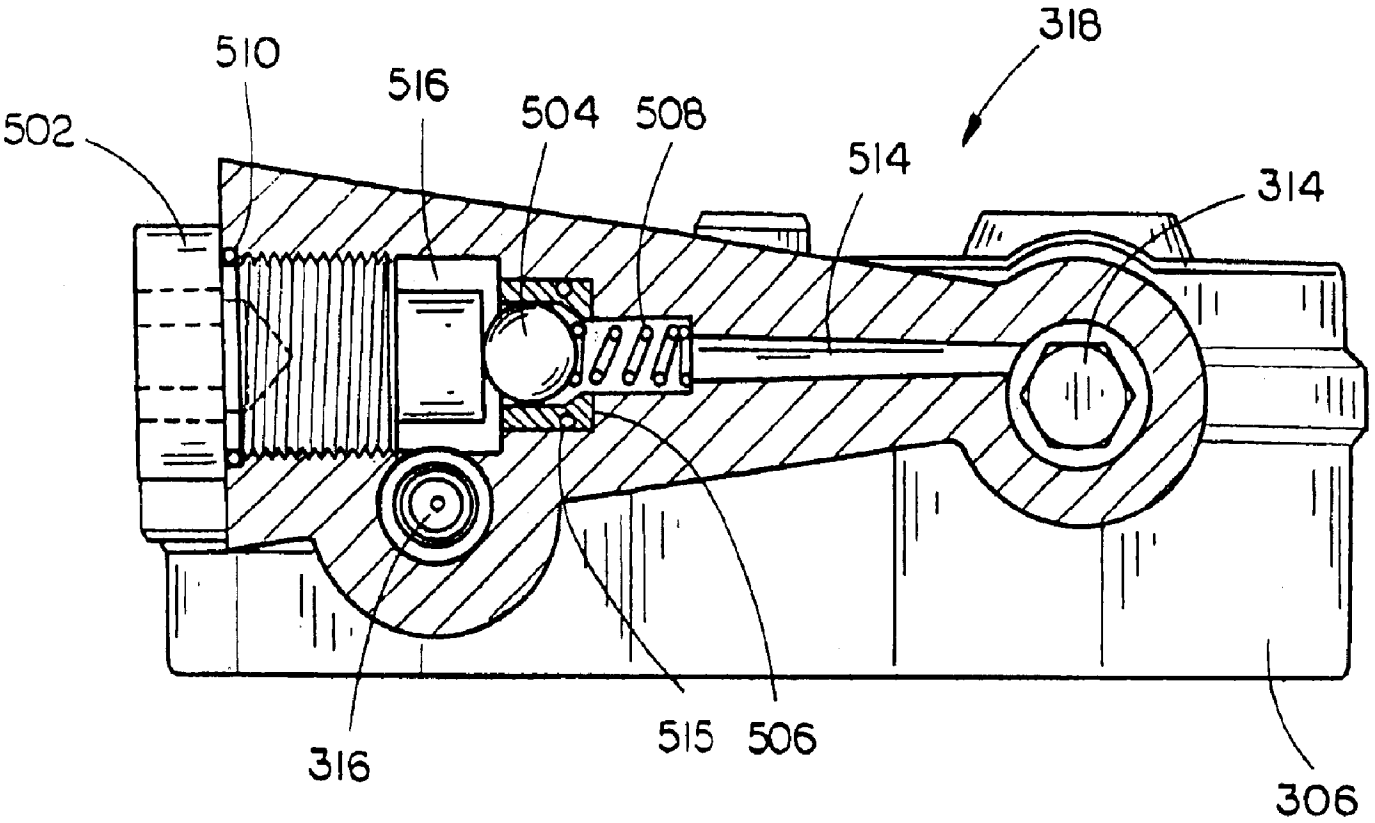

Referring now to FIGS. 11, 12A and 12B, the start valve 318 is described in greater detail. In an exemplary embodiment, start valve 318 is comprised of a valve body 398 formed in the head assembly 306 in which a ball valve assembly 500 is disposed. A plug 502 is provided for enclosing the ball valve assembly in the valve body 398. As shown in FIG. 11, ball valve assembly 500 includes ball 504, ball seat 506, and spring 508. Suitable seals 510 & 512 such as O-rings, washers, or the like may be provided for preventing loss of the fluid being pumped past plug 502, and for preventing seepage of the fluid from the past the ball seat 506 from the outlet portion 316 to the inlet portion when the start valve 318 is closed.

When the engine, powering pump 300, is not running, ball valve assembly 500 is biased open as shown in FIG. 12A. Ball 504 of ball valve assembly 500 is held away from ball seat 506 by spring 508. When a source of fluid, for example, water supplied by a conventional garden hose, is attached to the inlet portion 312 of head assembly 306 via connector 314 (FIG. 7), fluid is allowed to pass from the inlet portion 312 though port 514 to the outlet portion 316 past ball valve assembly 500. In this manner, fluid is allowed to circulate through the head assembly 306 bypassing the pump assembly 302. Consequently, as the engine is started, it does not have to overcome the buildup of pressure within the fluid in cylinders 340.

After the engine is started, pumping of the fluid by the pump assembly 322 increases the pressure, volume, and rate of flow of fluid in the outlet portion 316 of the head assembly 306. As shown in FIG. 12B, once a predetermined rate of flow is achieved, the pressure of fluid in the outlet portion 316 of head assembly 306 overcomes spring 508 and causes ball 504 to be forced against ball seat 506 substantially or completely blocking port 514, closing the start valve 318. In this manner, the fluid is not allowed to bypass the pump assembly 302 by circulating through the head assembly 306 so that the fluid may be pumped.

Figure 13:
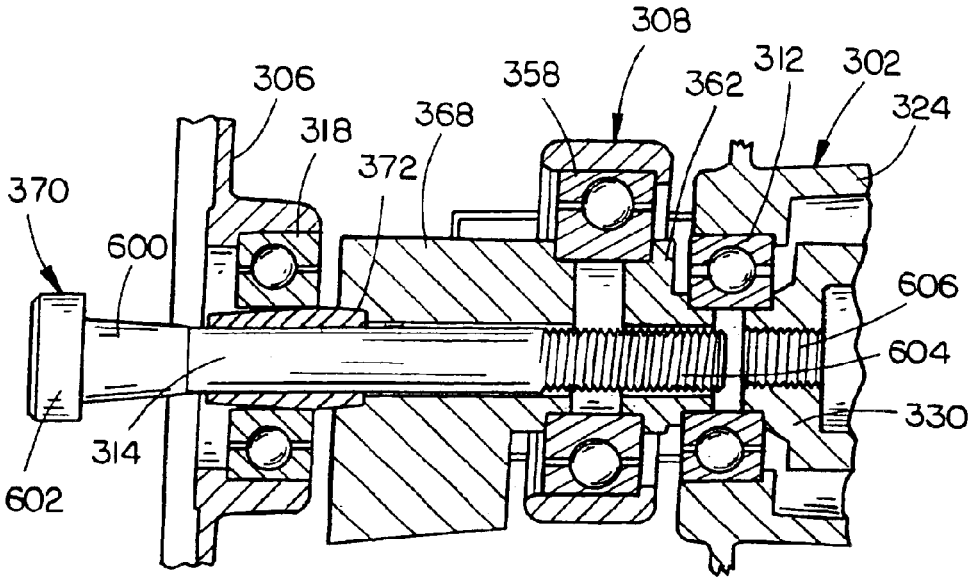
FIGS. 13 and 14 are cross-sectional views of the pump shown in FIG. 6, further illustrating capture of the bearing assembly by the apparatus of the present invention
Figure 14:
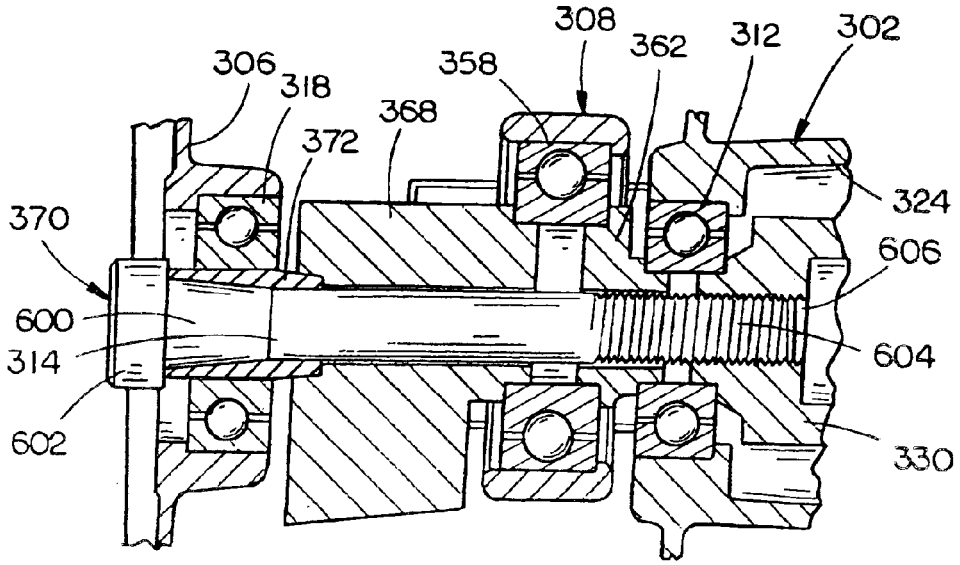

Turning now to FIGS. 13 and 14, capture of bearing assembly 318 by bearing capture apparatus comprised of fastener 370 and collet 372 is described. In accordance with an exemplary embodiment of the present invention, fastener 370 and collet 372 capture bearing assembly 318 by securing the bearing assembly 318 to eccentric assembly 308. The collet 372 is disposed within the bearing assembly 318 around the fastener 270. When tightened, the fastener 270 at least partially expands the collet 272 axially, causing the collet 272 to engage and capture the bearing assembly 318. In this manner, the amount of pre-load placed on the bearing assembly 318 is controlled.

In the exemplary embodiment shown, fastener 370 includes a tapered portion 600, a head portion 602 adjacent to tapered portion 600, and a threaded end 604 opposite head portion 602 and tapered portion 600. As shown, fastener 370 extends through bearing assembly 318, counterweight 368, ring bearing assembly 360, bearing coupling member 362, and bearing assembly 312, whereupon threaded end 604 is screwed into a threaded hole 606 formed in shaft 330 to clamp the components of the eccentric assembly 308 together. Preferably, fastener 370 is off-centered in bearing coupling member 362 so that the ring bearing assembly 360 is positioned axially off-center with respect to the center of shaft 330 allowing the eccentric 358 to convert the rotary motion of the shaft 330 to rectilinear motion that is communicated to the piston assemblies 304 by straps 310 for reciprocating pistons 342.

Collet 372 is disposed in bearing assembly 318 around the fastener 370. As fastener 370 is threaded into shaft 330, as shown in FIG. 13, tapered portion 600 is forced into collet 372, at least partially expanding or spreading the collet 372 within bearing assembly 318 as shown in FIG. 14. Expansion of the collet 372 causes the collet 372 to engage the bearing assembly 318 capturing the bearing assembly 318. Preferably, head portion 602 holds the collet 372 within the bearing assembly 318 and engages the outer surface of bearing assembly 318 for clamping the components of the eccentric assembly 308 together. Head portion 602 may also provide a means of gripping the fastener 370 so that it may be threaded into shaft 330.

In exemplary embodiments of the invention, tapered portion 600 of fastener 370 may have a generally conical cross-section. However, it will be appreciated that tapered portion 600 may have other cross-sections, such as, for example, faceted, curved or curvilinear cross-sections, as contemplated by one of ordinary skill in the art without departing from the scope and spirit of the invention. Further, as shown in FIG. 6, collet 372 may include one or more longitudinally formed slits for aiding expansion of the collet 372 and for allowing the collet to expand substantially uniformly in all axial directions.

Figure 16:
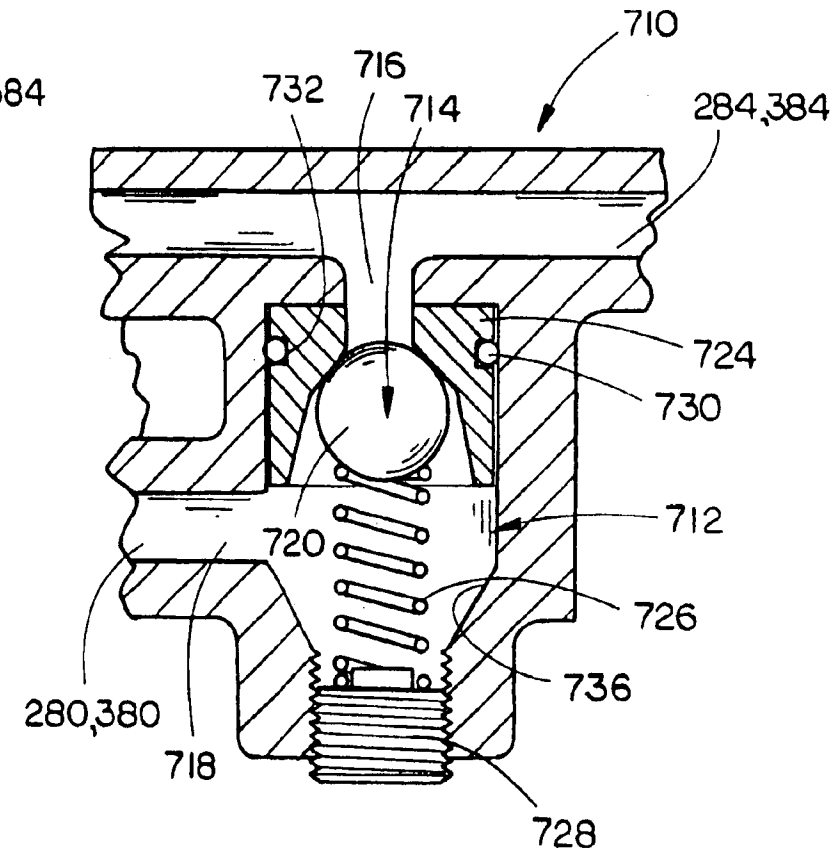
FIGS. 15 and 16 are schematic views illustrating exemplary pressure unloader valves for a pump such as the pump shown in FIGS. 2 & 6 in accordance with an exemplary embodiment of the present invention.
Figure 15:
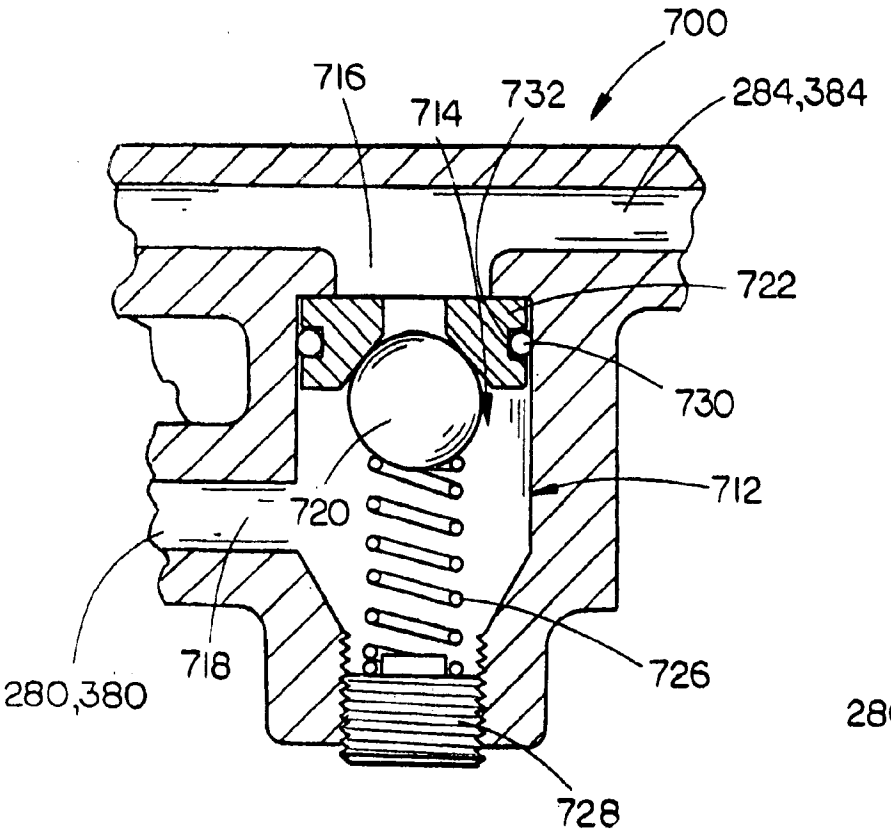

Referring now to FIGS. 15 and 16 exemplary pressure unloader valves for a pump such as the pump shown in FIGS. 2 and 6 are described in accordance with an exemplary embodiment of the present invention. Pressure unloader valves 700 & 710 functionally respond to changes in pressure or flow in high pressure outlet portion 284 & 384 of the head assemblies 206 & 306 of pumps 200 (FIG. 2) & 300 (FIG. 6), respectively, due to, for example, a spray wand being turned "on" and "off", or the like. For instance, when such a spray wand is turn "on" so that spray wand is operative for delivering a spray of fluid (e.g., water) under pressure, unloader valves 700 & 710 delivers pressurized fluid from the pump 200 or 300 to the spray wand. However, when the spray wand is "off" so that spray wand is not operative to deliver a spray of fluid under pressure, unloader valves 700 & 710 at least substantially interrupt the flow of fluid to the spray wand, and bypass the flow of fluid back to low pressure inlet portions 280, 380 of pumps 200, 300, thereby relieving pressure in high pressure outlet portion 284, 384.

In the exemplary embodiments shown, pressure unloader valves 700 & 710 comprise a valve body 712, formed in the head assembly 306 in which a ball valve assembly 714 is disposed. Valve body 712 includes a first port 716 to high pressure fluid from high pressure outlet portion 284, 384 and a second port 718 to low pressure fluid from low pressure portion 280, 380. Ball valve assembly 712 includes ball 720, ball seat 722 (FIG. 15) or 724 (FIG. 16) and spring 726. A threaded plug 728 engages an end of spring 726, holding spring 726 in place and enclosing ball valve assembly 714 in valve body 712. A seal 730 such as an O-ring, washer, or the like may be disposed in an annular groove 732 formed in ball seat 722 for preventing seepage of high pressure fluid past ball seat 722 when the pressure unloader valve 700 is closed.

Ball valve assembly 714 is biased closed by spring 726 as shown in FIGS. 15 and 16 wherein ball 720 is held in contact with a generally conical recess 734 in ball seat 722 or 724. When flow through high pressure outlet portion 284, 384 is sufficient, the pressure on ball 720 at port 716 is incapable of overcoming the bias provided by spring 726 allow ball 720 to remain seated within recess 734 of ball seat 722 and preventing bypass flow of fluid through the pressure unloader valve 700 or 710. However, when flow through high-pressure outlet portion 284, 384 is reduced to a predetermined level, pressure at port 716 is increased, overcoming the bias provided by spring 726. Ball 720 is forced away from recess 734 allowing fluid to flow through valve body 712 where it is ported to low pressure inlet portion 280, 380 via port 718. In this manner, high pressure fluid is bypassed from high pressure outlet portion 284, 384 to low pressure inlet portion 280, 380, thus relieving pressure in the high pressure outlet portion and any hoses, spray wands, and the like attached thereto.

In exemplary embodiments, the amount of bias provided by spring 726, and thus the pressure wherein ball 722 is forced away from ball seats 722 & 724 so that unloader valves 700 & 710 are opened, may be controlled by adjusting the length of valve body 712 and thus the degree of compression of spring 726 within the valve body 712. This adjustment is accomplished via threading plug 728. By threading plug 728 into valve body 712, the length of valve body 712 is decreased, compressing spring 726 and increasing the bias placed on ball 722. Conversely, by threading plug 728 outwardly from valve body 712, the length of valve body 712 is increased, reducing compression of spring 726 and reducing the bias placed on ball 722.

In the embodiment shown in FIG. 15, pressure unloader valve 700 includes a ball seat 722 having a simple conical recess 734 against which ball 720 is biased by spring 726. In the embodiment shown in FIG. 16, ball seat 722 is lengthened to provide a restriction portion 736 having a generally conical internal cross-section to further control bypass pressure of the unloader valve 710. Restriction portion 736 forms an annular orifice in which ball 720 floats, when pressure unloader valve 700 is open, thereby preventing ball 720 from prematurely or intermittently seating in ball seat 722 due to pressure variations at port 716 to minimize surging by the pump.

Figure 17:
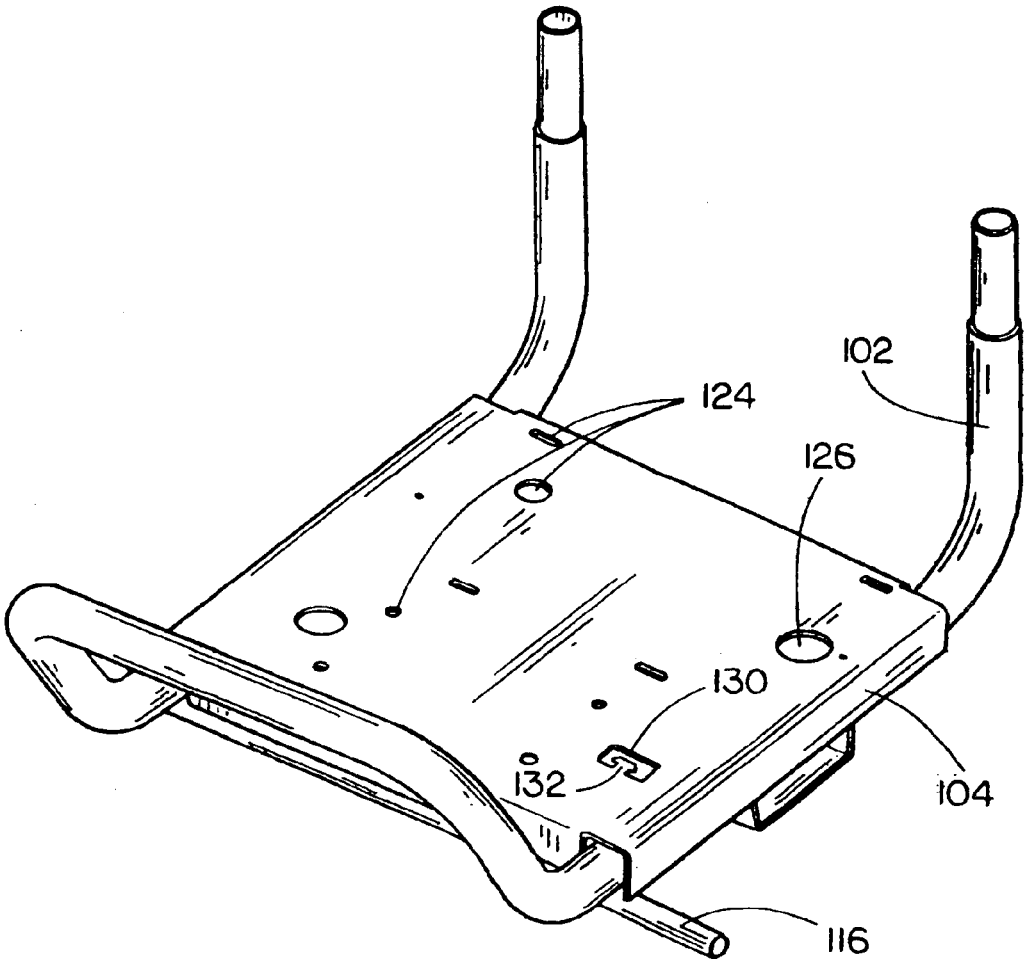
FIG. 17 is an isometric view further illustrating the frame and engine/pump platform of the pressure washer shown in FIG. 1.

Turning now to FIG. 17, the engine/pump platform of the pressure washer shown in FIG. 1 is described. Engine/pump platform 104 is mounted to frame 102 between handle portion 108 and bumper portion 110. In the embodiment shown, engine/pump platform is comprised of a tray or pan formed of sheet metal, or alternately, a plastic or composite material, attached to the frame 102 via a suitable fastening apparatus (e.g., bolts, screws, rivets, welds, etc.). Apertures 124 may be formed in the platform 104 for attachment of the engine 106 (FIG. 1), pump 200 (FIG. 2) or 300 (FIG. 6), and shroud 122 (FIG. 6). Likewise, an aperture 126 may be provided through which pulse hose 392 may extend.

Figure 18:
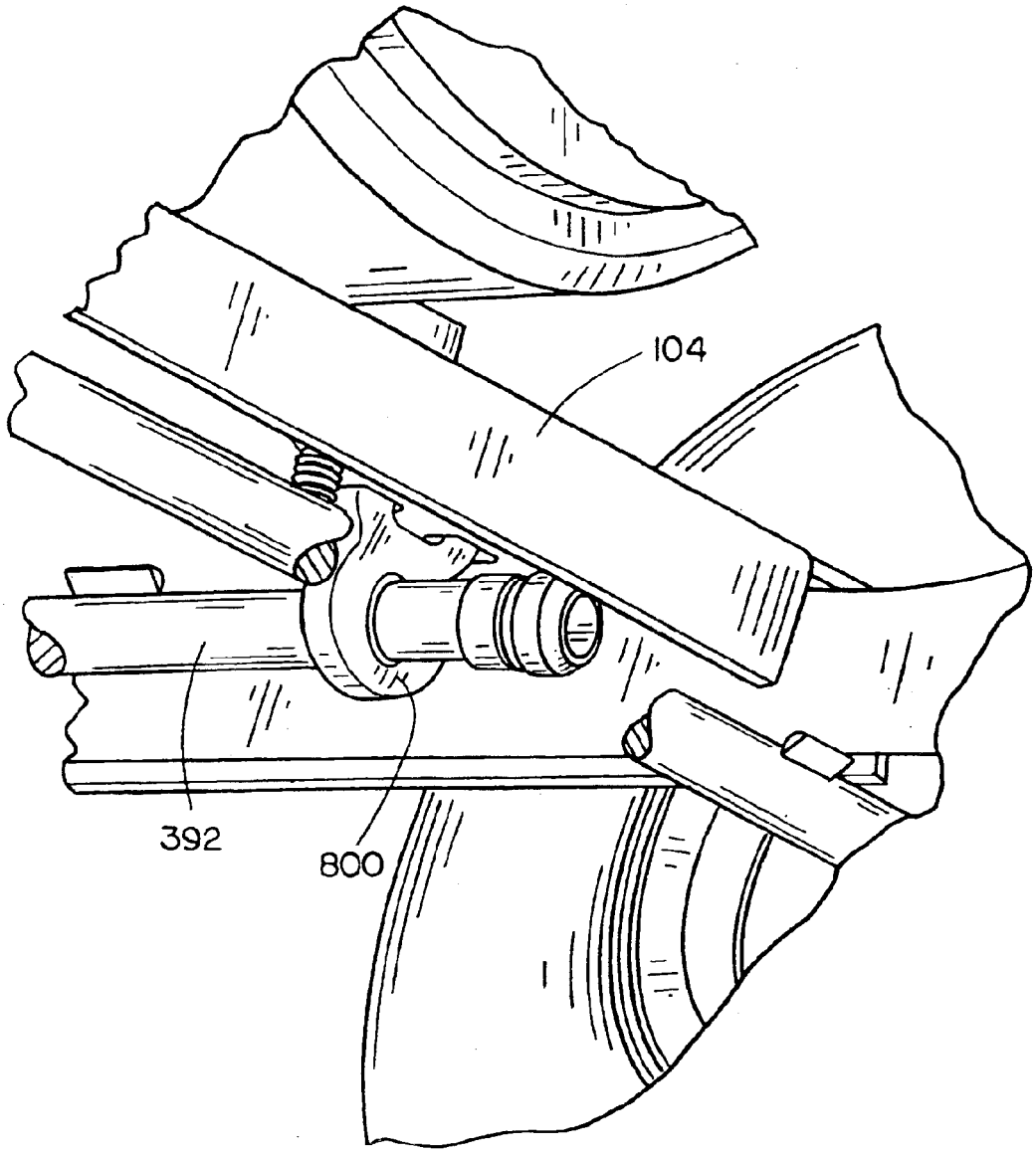
FIG. 18 is an isometric view illustrating retention of the pulse hose to the engine/pump platform in accordance with an exemplary embodiment of the present invention.
Figure 19:
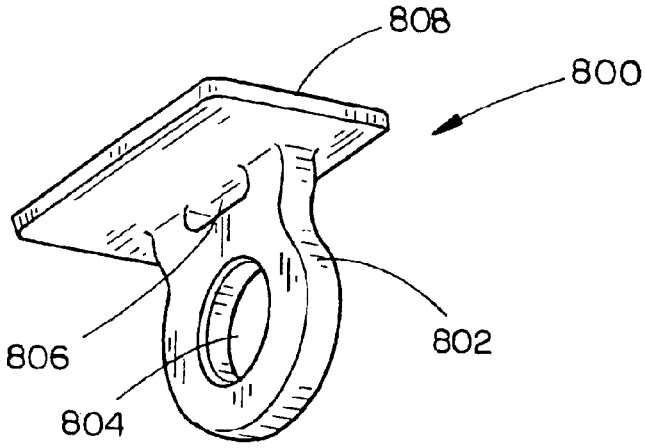
FIG. 19 is an isometric view illustrating the pulse hose retainer shown in FIG. 18.
Figure 20:
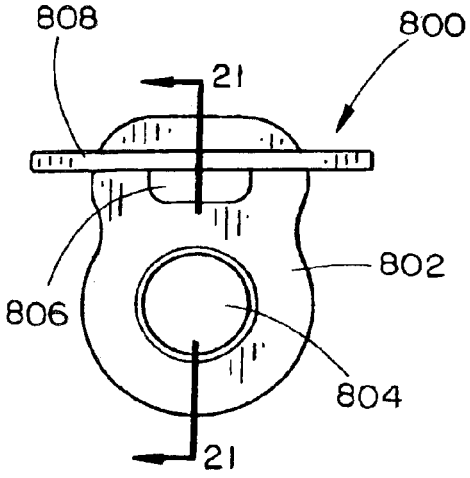
FIG. 20 is a side elevational view of the pulse hose retainer shown in FIG. 19.
Figure 21:
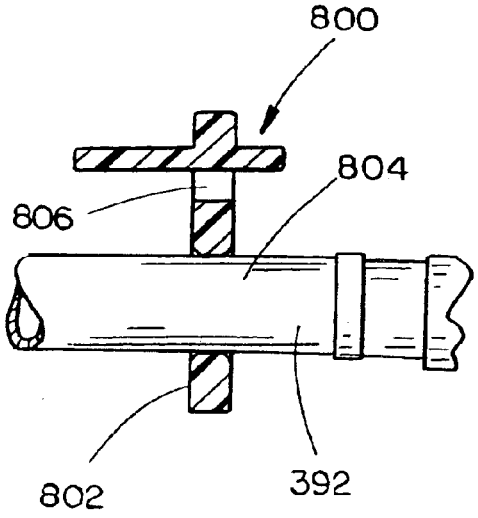
FIG. 21 is a cross-sectional side elevational view of the pulse hose retainer shown in FIGS. 19 and 20 taken along line 21—21 in FIG. 20.

Referring now to FIGS. 17, 18, 19, 20 and 21, retention of the pulse hose 392 of the oilless high pressure pump 300 shown in FIGS. 6 through 10B to the engine/pump platform 104 in accordance with an exemplary embodiment of the present invention is described. As shown in FIGS. 17 and 18, pulse hose 392 extends through aperture 126 in engine/pump platform 104 so that it is disposed adjacent but generally spaced apart from the bottom surface of the platform. The outer end of the pulse hose 392 extends through a pulse hose keeper or retainer 800, which secures the pulse hose to the engine/pump platform 104 while allowing the pulse hose 392 to expand and lengthen to absorb pressure pulsation in the fluid induced by pumping.

Figure 10A:
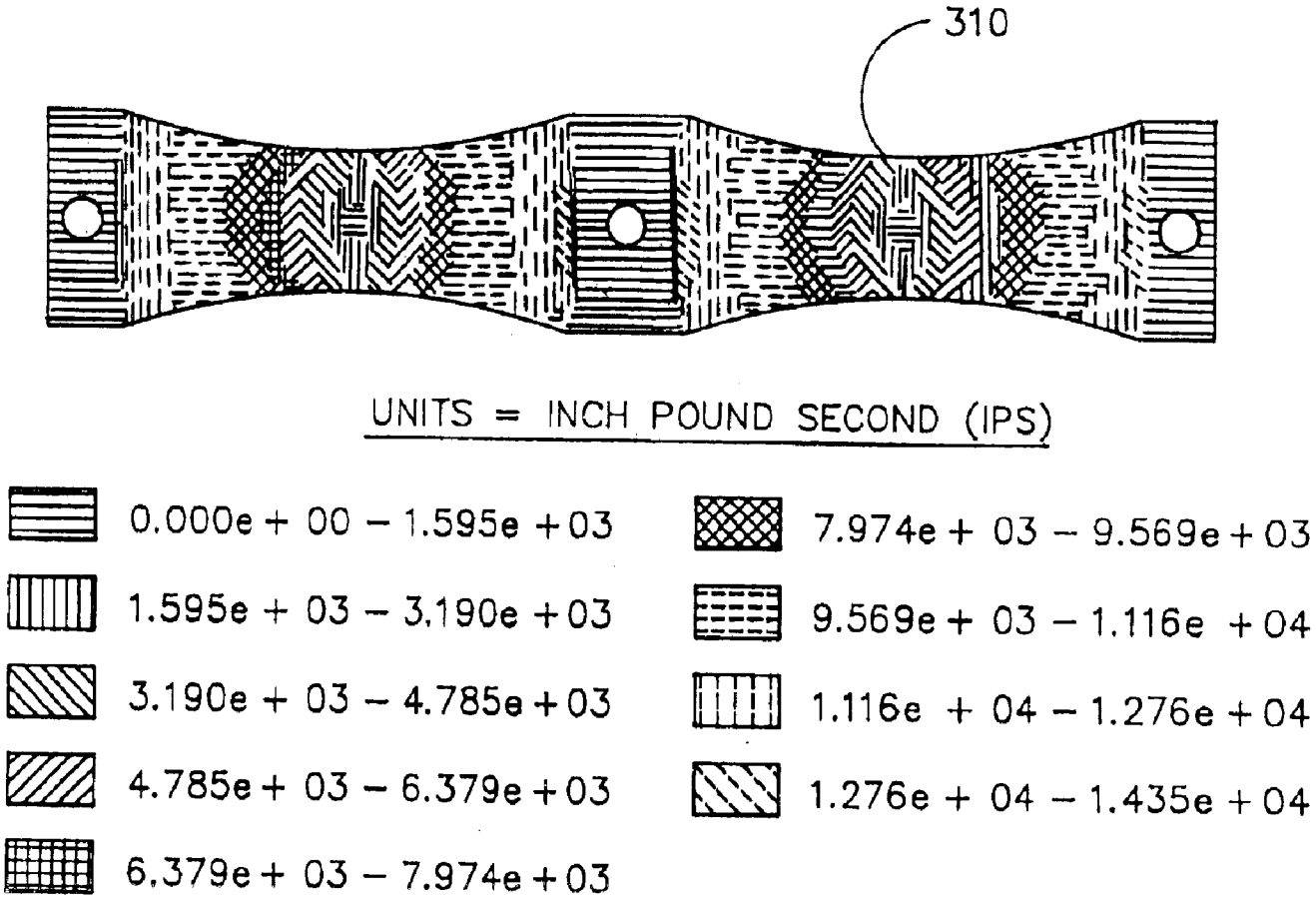
FIGS. 10A and 10B are graphical representations of the results of a finite element analysis of an exemplary flexible strap of the pump in accordance with the present invention.
Figure 10B:
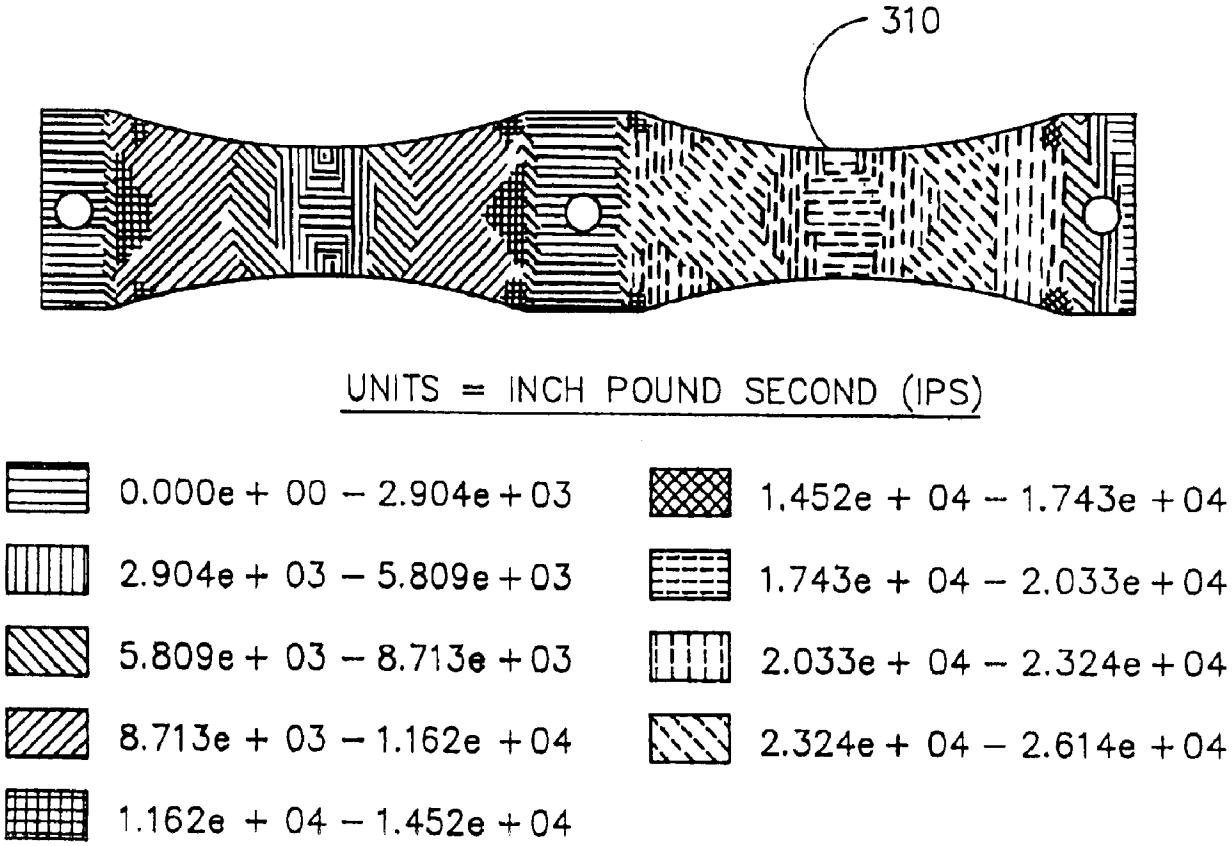

In the exemplary embodiment shown in FIGS. 9, 10 and 11, pulse hose retainer 800 may comprise a body 802 having a first aperture 804 through which pulse hose 392 may extend (see FIG. 11), and a second aperture 806 providing attachment to engine/pump platform 104, or, alternately, other pressure washer 100 frame components. For instance, in the exemplary embodiment shown in FIGS. 17 through 21, engine/pump platform 104 may include an aperture 130 having a pronged tab 132 formed therein. The body 802 of pulse hose retainer 800 extends downwardly through aperture 130 allowing the prongs of tab 132 to engage aperture 806 securing the pulse hose retainer 800 to the engine/pump platform 104. A cap 808 formed in body 802 covers aperture 130 helping to hold the pulse hose retainer 800 in place and preventing debris from passing through aperture 130. The pulse hose 392 extends through aperture 804 and is held in place adjacent to the bottom surface of the engine/pump platform 104. In exemplary embodiments, pulse hose retainer 130 is formed of a flexible material, such as a flexible polyvinyl chloride (PVC), a rubber, or the like to allow the pulse hose to more easily to expand and contract and to allow the retainer 800 to be engaged by tab 232.

It is believed that the present invention and many of its attendant advantages will be understood by the forgoing description, and it will be apparent that various changes may be made in the form, construction and arrangement of the components thereof without departing from the scope and spirit of the invention or without sacrificing all of its material advantages, the form herein before described being merely an explanatory embodiment thereof. It is the intention of the following claims to encompass and include such changes.

What is claimed is:

1. A pressure washer, comprising a frame;

an engine mounted to said frame; and a pump coupled to said engine, said pump further comprising:

a piston assembly including a piston;

an eccentric assembly suitable for converting rotary motion of a rotating shaft to rectilinear motion; and a strap for coupling said eccentric assembly and said piston assembly;

a pulse hose for absorbing pressure pulsation in the liquid induced by pumping; and a pressure unloader valve including a valve body having a high pressure port and a low pressure port; a ball valve assembly received in the valve body, the ball valve assembly including a ball, a ball seat disposed against the high pressure port, a spring suitable for biasing the ball against the ball seat; and a plug received in the valve body, the plug being threaded into the valve body for controlling the amount of bias placed on the ball by the spring, wherein said strap is suitable for communicating the rectilinear motion of said eccentric assembly to said piston assembly for reciprocating said piston in said cylinder to pump said liquid.

2. The pressure washer as claimed in claim 1, wherein said eccentric assembly comprises:

a shaft suitable for being coupled to a drive shaft of an engine;

at least one bearing assembly for supporting said shaft in said pump housing so that said shaft may rotate; and an eccentric for converting the rotary motion of said shaft to rectilinear motion.

3. The pressure washer as claimed in claim 2, wherein said eccentric assembly further comprises a counterweight assembly coupled to said shaft for counterbalancing movement of said piston assembly.

4. The pressure washer as claimed in claim 1, wherein said strap is flexible.

5. The pressure washer as claimed in claim 1, wherein each piston assembly further comprises a strap coupling member and clamping block for coupling said piston assembly to said strap.

6. The pressure washer as claimed in claim 1, wherein said piston is formed of one of ceramic and nitrated steel.

7. The pressure washer as claimed in claim 1, further comprising a head assembly for porting said liquid through said pump.

8. The pressure washer as claimed in claim 1, further comprising a pulse hose retainer for retaining said pulse hose.

9. The pressure washer as claimed in claim 8, wherein the pulse hose retainer comprises a body having a first aperture and a second aperture, the first aperture being suitable for receiving said pulse hose, and the second aperture being suitable for securing said pulse hose retainer to said frame.

10. A pressure washer, comprising a frame assembly, an engine mounted to said frame assembly; and a pump mounted to said frame assembly and coupled to said engine, said pump further comprising:

a pump assembly having at least one piston assembly, said piston assembly driven by said engine for pumping the liquid from a first pressure to a second pressure;

a head assembly coupled to said pump assembly, said head assembly including an inlet portion suitable for receiving the liquid at the first pressure and an outlet portion suitable for outputting the liquid at the second pressure; and a pressure unloader valve including a valve body having a high pressure port and a low pressure port; a ball valve assembly received in the valve body, the ball valve assembly including a ball, a ball seat disposed against the high pressure port, a spring suitable for biasing the ball against the ball seat; and a plug received in the valve body, the plug being threaded into the valve body for controlling the amount of bias placed on the ball by the spring, wherein said pressure unloader valve opens for circulating the liquid within said head assembly from said inlet portion to said outlet portion as said pump is started and closes for circulating the liquid through said piston assembly once a predetermined rate of flow of the liquid through the pump is achieved.

11. The pressure washer as claimed in claim 10, wherein said head assembly includes a formed valve body having a port from said inlet portion to said outlet portion.

12. The pressure washer as claimed in claim 11, wherein said valve assembly includes a ball, a ball seat, and a spring, wherein said ball is held away from said ball seat by said spring as said pump is started opening said port and allowing circulation of the liquid between said inlet portion and said outlet portion, and wherein the liquid forces said ball against said ball seat overcoming said spring to at least partially block said port once the predetermined flow of the liquid is achieved.

13. The pressure washer as claimed in claim 12, further comprising a plug for closing said valve body.

14. The pressure washer as claimed in claim 10, further comprising:

an eccentric assembly suitable for converting rotary motion of a rotating shaft of the engine to rectilinear motion; and a flexible strap for coupling said eccentric assembly and said piston assembly;

wherein said strap is suitable for communicating the rectilinear motion of said eccentric assembly to said piston assembly for reciprocating said piston to pump said liquid.

15. The pressure washer as claimed in claim 14, wherein said eccentric assembly comprises:

a shaft suitable for being coupled to the drive shaft of an engine;

at least one bearing assembly for supporting said shaft in said pump assembly so that said shaft may rotate; and an eccentric for converting the rotary motion of said shaft to rectilinear motion.

16. The pressure washer as claimed in claim 15, wherein said at least one bearing assembly comprises a sealed bearing.

17. The pressure washer as claimed in claim 15, wherein said eccentric assembly further comprises a counterweight assembly coupled to said shaft for counterbalancing said piston assembly.

18. The pressure washer as claimed in claim 14, wherein the strap is shaped so that loads within the strap are distributed substantially uniformly throughout the strap.

19. A pump for pumping a liquid, comprising a pump housing;

a head assembly coupled to the pump housing, a cylinder being formed in the pump housing and head assembly;

a piston assembly disposed in the cylinder, the piston assembly including a piston capable of reciprocating within the cylinder;

an eccentric assembly suitable for converting rotary motion of a rotating shaft to rectilinear motion; and a strap for coupling the eccentric assembly and the piston assembly;

wherein the strap is suitable for communicating the rectilinear motion of the eccentric assembly to the piston assembly for reciprocating the piston in the cylinder to pump the liquid.

20. The pump as claimed in claim 19, wherein the eccentric assembly comprises:

a shaft suitable for being coupled to a drive shaft of an engine;

at least one bearing assembly for supporting the shaft in the pump housing so that the shaft may rotate; and an eccentric for converting the rotary motion of the shaft to rectilinear motion.

21. The pump as claimed in claim 20, wherein the eccentric assembly further comprises a counterweight assembly coupled to the shaft for counterbalancing the piston assembly.

22. The pump as claimed in claim 19, wherein the piston assembly further comprises a strap coupling assembly for coupling the piston to the strap.

23. The pump as claimed in claim 19, wherein the head assembly includes a port for porting the liquid.

24. The pump as claimed in claim 19, wherein the ball seat includes a restriction portion in which the ball floats for at to at least partially reduce surging of the pump.

* * * * *